US009785069B2

(12) United States Patent
Iida et al.

(10) Patent No.: US 9,785,069 B2
(45) Date of Patent: Oct. 10, 2017

(54) IMAGE FORMING APPARATUS, ELECTROSTATIC CHARGE IMAGE DEVELOPER, AND ELECTROSTATIC CHARGE IMAGE DEVELOPING TONER

(71) Applicant: FUJI XEROX CO., LTD., Tokyo (JP)

(72) Inventors: Yoshifumi Iida, Kanagawa (JP); Hiroyoshi Okuno, Kanagawa (JP); Satoshi Inoue, Kanagawa (JP); Tomohito Nakajima, Kanagawa (JP); Yuka Zenitani, Kanagawa (JP); Yoshifumi Eri, Kanagawa (JP); Takeshi Iwanaga, Kanagawa (JP); Sakae Takeuchi, Kanagawa (JP); Shunsuke Nozaki, Tokyo (JP); Yasuo Kadokura, Kanagawa (JP); Yasuhisa Morooka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/221,290

(22) Filed: Jul. 27, 2016

(65) Prior Publication Data

US 2017/0227865 A1 Aug. 10, 2017

(30) Foreign Application Priority Data

Feb. 10, 2016 (JP) ..... 2016-024136

(51) Int. Cl.

| | |
|---|---|
| ***G03G 9/097*** | (2006.01) |
| ***G03G 9/08*** | (2006.01) |
| ***G03G 9/087*** | (2006.01) |
| ***G03G 9/09*** | (2006.01) |
| ***G03G 9/107*** | (2006.01) |
| ***G03G 9/113*** | (2006.01) |
| ***G03G 15/08*** | (2006.01) |

(52) U.S. Cl.

CPC ..... *G03G 9/0827* (2013.01); *G03G 9/0819* (2013.01); *G03G 9/08711* (2013.01); *G03G 9/08755* (2013.01); *G03G 9/0902* (2013.01); *G03G 9/0918* (2013.01); *G03G 9/09716* (2013.01); *G03G 9/09725* (2013.01); *G03G 9/107* (2013.01); *G03G 9/1131* (2013.01); *G03G 15/08* (2013.01)

(58) Field of Classification Search

CPC ..... G03G 9/09725; G03G 9/09716; G03G 9/0819; G03G 9/0827

USPC ..... 430/108.7, 110.4, 110.3

See application file for complete search history.

(56) References Cited

U.S. PATENT DOCUMENTS

| | | | | |
|---|---|---|---|---|
| 7,264,911 | B2 * | 9/2007 | Matsumura | G03G 15/1685 399/252 |
| 2009/0233210 | A1 * | 9/2009 | Ninomiya | G03G 9/0819 430/109.4 |
| 2010/0196814 | A1 * | 8/2010 | Joo | G03G 9/0806 430/108.4 |
| 2014/0370427 | A1 * | 12/2014 | Sasaki | G03G 9/09725 430/105 |

FOREIGN PATENT DOCUMENTS

| | | | |
|---|---|---|---|
| JP | 2012-128176 | A | 7/2012 |
| JP | 2013166667 | A | 8/2013 |
| JP | 2014-029511 | A | 2/2014 |

OTHER PUBLICATIONS

Aug. 1, 2017 Office Action issued in Japanese Patent Application No. 2016-024136.

* cited by examiner

*Primary Examiner* — Janis L Dote
(74) *Attorney, Agent, or Firm* — Oliff PLC

(57) ABSTRACT

An image forming apparatus includes a developing unit that contains an electrostatic charge image developer and develops an electrostatic charge image formed on the surface of an image holding member as a toner image by using the developer, wherein the developer contains a carrier and an electrostatic charge image developing toner that includes a toner particle and an external additive, the toner particles have an average circularity of from 0.98 to 1.00 and a number-particle diameter distribution index (lower GSD) on a small diameter side of 1.22 or more and contain at least a vinyl resin, and the external additive contains silica particles having a compression aggregation degree of 60% to 95% and a particle compression ratio of 0.20 to 0.40.

7 Claims, 2 Drawing Sheets

IMAGE FORMING APPARATUS, ELECTROSTATIC CHARGE IMAGE DEVELOPER, AND ELECTROSTATIC CHARGE IMAGE DEVELOPING TONER

CROSS-REFERENCE TO RELATED APPLICATIONS

This application is based on and claims priority under 35 USC 119 from Japanese Patent Application No. 2016-024136 filed Feb. 10, 2016.

BACKGROUND

1. Technical Field

The present invention relates to an image forming apparatus, an electrostatic charge image developer, and an electrostatic charge image developing toner.

2. Related Art

A method of visualizing image information from an electrostatic charge image by electrophotography has been recently used in various fields. By the electrophotography, image information is formed as an electrostatic charge image on a surface of an image holding member (photoreceptor) in charging and exposure processes, a toner image is developed on the surface of the photoreceptor by using a developer containing a toner, the toner image is subjected to a transfer process for transferring the toner image to a recording medium such as a sheet and a fixing process for fixing the toner image on the surface of the recording medium, and the image is thus visualized.

SUMMARY

According to an aspect of the invention, there is provided an image forming apparatus including:

an image holding member;

a charging unit that charges a surface of the image holding member;

an electrostatic charge image forming unit that forms an electrostatic charge image on a charged surface of the image holding member;

a developing unit that contains an electrostatic charge image developer and develops the electrostatic charge image formed on the surface of the image holding member as a toner image by using the electrostatic charge image developer;

a transfer unit that transfers the toner image formed on the surface of the image holding member to a surface of a recording medium;

a cleaning unit that includes a cleaning blade for cleaning the surface of the image holding member; and a fixing unit that fixes the toner image transferred to the surface of the recording medium, wherein the electrostatic charge image developer contains a carrier and an electrostatic charge image developing toner that includes a toner particle and an external additive;

the toner particles have an average circularity of from 0.98 to 1.00 and a number-particle diameter distribution index (lower GSD) on a small diameter side of 1.22 or more and contain at least a vinyl resin; and the external additive that contains silica particles having a compression aggregation degree of 60% to 95% and a particle compression ratio of 0.20 to 0.40.

BRIEF DESCRIPTION OF THE DRAWINGS

Exemplary embodiments of the present invention will be described in detail based on the following figures, wherein.

DETAILED DESCRIPTION

Figure 1:
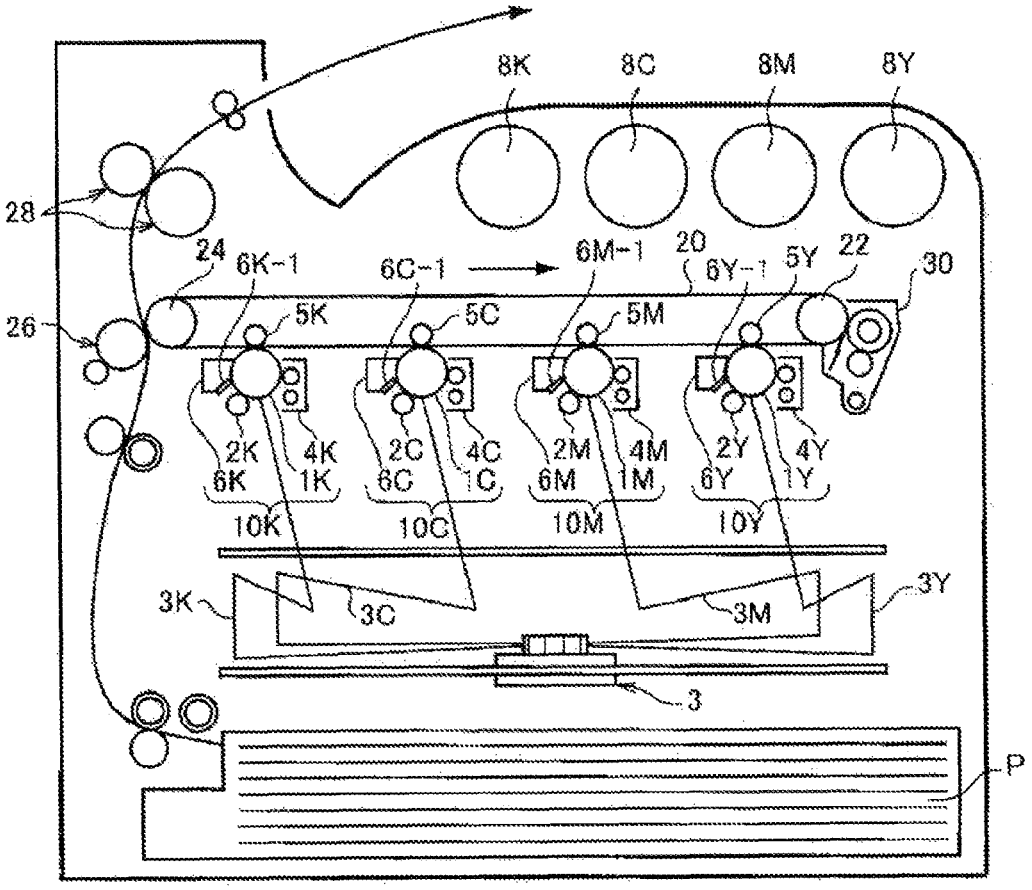
FIG. 1 is a configuration diagram schematically illustrating an example of an image forming apparatus according to an exemplary embodiment.

Hereinafter, description will be given of an exemplary embodiment of the invention as an example.

Electrostatic Charge Image Developing Toner

An electrostatic charge image developing toner (hereinafter, referred to as a "toner") according to the exemplary embodiment is a toner that includes toner particles that have an average circularity from 0.98 to 1.00 and a number-particle diameter distribution index (lower GSD) on a small diameter side of 1.22 or more and contain at least vinyl resin, and an external additive.

The external additive contains silica particles with a compression aggregation degree from 60% to 95% and a particle compression ratio from 0.20 to 0.40 (hereinafter, also referred to as "specific silica particles").

Here, if an externally added structure of silica particles (a state where the silica particles adhere to toner particles) changes in a toner in the related art in which the silica particles are externally added to the toner particles, then fluidity of the toner may deteriorate, and a charge holding property may deteriorate. The silica particles move on the toner particles and are localized, or the silica particles flake from the toner particles, for example, and these are reasons of the change in the externally added structure. In a case of applying toner particles with average circularity that is as high as 0.98 to 1.00, which have almost spherical shapes, in particular, movement on the toner particles and flaking from the toner particle tend to occur, and the externally added structure tend to change.

If the toner particles with the average circularity that is as high as 0.98 to 1.00, which have almost spherical shapes, are applied, the toner particles tend to pass through the cleaning blade when the same image is repeatedly formed. If the toner particles have almost spherical shapes, the surfaces thereof are substantially smooth, and the toner particles are not easily scraped at the cleaning unit (the contact portion between the cleaning blade and the photoreceptor (image holding member)). Therefore, the toner particles tend to sip if the same image is repeatedly formed and a large number of toner particles reach the same region in the cleaning unit.

In contrast, the silica particles externally added to the toner particles flake from the toner particles due to a mechanical loads caused by stirring in a developing unit or scraping in the cleaning unit, for example, in some cases. If the flaking silica particles reach the cleaning unit, then the silica particles are stopped at a tip end of the cleaning unit (a site of a contact portion between the cleaning blade and the photoreceptor on a downstream side in a rotation direction) and forms an aggregate (hereinafter, also referred to as an "externally added dam") by a pressure from the cleaning blade. The externally added dam contributes to an improvement in a cleaning property.

However, a large number of silica particles (silica particles at the externally added dam) stopped at the cleaning unit also pass when the toner particles pass, and the silica particles cause crack on the photoreceptor in some cases. Crack is caused on the photoreceptor when the silica particles pass through the cleaning blade. If crack is caused on the photoreceptor, defect in image quality such as streak occurs at the portion.

Thus, the toner according to the exemplary embodiment exhibits an excellent charge holding property and prevents crack on the photoreceptor caused when the same image is repeatedly formed by externally adding specific silica particles to the toner particles. If the toner according to the exemplary embodiment is applied to an image forming apparatus or the like, defect in image quality due to deterioration of the charge holding property of the toner (such as a change in image density over elapse of time) and defect in image quality due to crack on the photoreceptor caused when the same image is repeatedly formed are prevented. The reason is inferred as follows.

The specific silica particles with the compression aggregation degree and the particle compression ratio within the above ranges are silica particles that have characteristics such as high fluidity, high dispersibility in the toner particles, a high cohesion, and high adhesion to the toner particles.

Here, silica particles typically have low adhesion and a characteristic of not easily aggregating since the silica particles have low bulk density while the silica particles exhibit satisfactory fluidity.

In contrast, a technique of treating surfaces of the silica particles by using a hydrophobizing agent for the purpose of enhancing both fluidity of the silica particles and dispersibility in the toner particles is known. According to the technique, the fluidity of the silica particles and the dispersibility in the toner particles are enhanced while the cohesion is maintained to be low.

In addition, a technique of treating the surfaces of the silica particles by using both a hydrophobizing agent and silicone oil is also known. According to the technique, the adhesion to the toner particles and the cohesion are enhanced. On the other hand, the fluidity and the dispersibility in the toner particles tend to deteriorate.

That is, it is possible to state that the fluidity and the dispersibility in the toner particles are in a conflict relationship with the cohesion and the adhesion to the toner particles in the silica particles.

In contrast, the specific silica particles have four satisfactory properties, namely the fluidity, the dispersibility in the toner particles, the cohesion, and the adhesion to the toner particles, by setting the compression aggregation degree and the particle compression ratio within the above ranges as described above.

Next, description will be given of meaning that the compression aggregation degree and the particle compression ratio of the specific silica particles are set within the above ranges in order.

First, description will be given of meaning that the compression aggregation degree of the specific silica particles is set to the range from 60% to 95%.

The compression aggregation degree is an index indicating the cohesion of the silica particles and the adhesion to the toner particles. The index is indicated by how difficult a silica particle compact is disentangled in a case of dropping the silica particle compact after obtaining the compact by compressing a silica particle.

Therefore, the silica particles tend to have higher bulk density, higher cohesive force (intermolecular force), and higher adhesion to the toner particles as the compression aggregation degree increases. A method of calculating the compression aggregation degree will be described later in detail.

Therefore, the specific silica with a compression aggregation degree that is controlled to be as high as 60% to 95% has satisfactory adhesion to the toner particles and cohesion. However, the upper limit of the compression aggregation degree is set to 95% in terms of obtaining satisfactory adhesion to the toner particles and satisfactory cohesion while securing the fluidity and the dispersibility in the toner particles.

Next, description will be given of the meaning that the particle compression ratio of the specific silica particles is set to be from 0.20 to 0.40.

The particle compression ratio is an index indicating the fluidity of the silica particles. Specifically, the particle compression ratio is represented by a ratio ((hardened apparent specific gravity−loosened apparent specific gravity)/hardened apparent specific gravity) between a difference of the hardened apparent specific gravity and the loosened apparent specific gravity and the hardened apparent specific gravity of the silica particles.

Therefore, a lower particle compression ratio represents higher fluidity of the silica particles. In addition, there is a tendency that the dispersibility in the toner particles increases as fluidity increases. A method of calculating the particle compression ratio will be described later in detail.

Therefore, the specific silica particles with a particle compression ratio that is controlled to be as low as 0.20 to 0.40 have satisfactory fluidity and dispersibility in the toner particles. However, the lower limit of the particle compression ratio is set to 0.20 in terms of obtaining satisfactory adhesion to the toner particles and satisfactory cohesion while obtaining the satisfactory fluidity and the dispersibility in the toner particles.

As describe above, the specific silica particles have unique characteristics, namely the high fluidity, easiness of being dispersed in the toner particles, the high cohesive force, and the high adhesion force to the toner particles. Therefore, the specific silica particles with the compression aggregation degree and the particle compression ratio within the above ranges are silica particles that have characteristics, namely the high fluidity, the high dispersibility in the toner particles, the high cohesion, and the high adhesion to the toner particles.

Next, description will be given of an assumed effect achieved when the specific silica particles are externally added to the toner particles.

First, if the specific silica particles are externally added to the toner particles, then the specific silica particles tend to adhere to the surfaces of the toner particles in a substantially uniform state due to the high fluidity and the dispersibility in the toner particles. The specific silica particles which have once adhered to the toner particle do not easily move on the toner particles and flake from the toner particles by the mechanical loads caused by the stirring in the developing unit, for example, since the specific silica particles have high adhesion to the toner particles. That is, the externally added structure does not easily change. Therefore, the fluidity of the toner particles themselves is enhanced, and also, the high fluidity tends to be maintained. As a result, the deterioration of the charge holding property is prevented even if the toner particles with an easily changed externally added structure and almost spherical shapes are applied.

In contrast, the specific silica particles which have flaked from the toner particles due to the mechanical loads caused by the scraping at the cleaning unit and have been supplied to the tip end of the cleaning unit aggregate by a pressure from the cleaning blade due to a high cohesion and form an externally added dam with high strength. Therefore, the externally added dam further enhances the cleaning property, and the passing of the toner particles is prevented even if the same image is repeatedly formed and a large amount of toner particles with almost spherical shapes reach the same region of the cleaning unit. In the related art, an installation pressure of the cleaning blade on the photoreceptor is set to be high to perform scraping in order to clean the toner particles with almost spherical shapes. If the installation pressure is set to be high, the cleaning property is enhanced while the amount of the photoreceptor worn and the crack on the photoreceptor tend to increase. In contrast, the passing of a large amount of silica particles (silica particles at the externally added dam) and the crack on the photoreceptor due to the passing of the silica particles are prevented without raising the installation pressure of the cleaning blade by using the specific silica.

Next, description will be given of meaning of the toner particles.

The toner particles have a feature that the surface thereof is smooth to satisfy the above average circularity. Furthermore, the toner particles have also a feature that the number-particle diameter distribution index (lower GSD) on the small diameter side is 1.22 or more and the toner particles contain at least vinyl resin. The number-particle diameter distribution index (lower GSD) on the small diameter side indicates a rate of the amount of fine toner particles. Toner particles including a small amount of fine particles and having high average circularity tends to be closest-packed between the cleaning blade and the photoreceptor when the toner is scraped by the cleaning unit. The closest-packing tends to raise the pressure between the cleaning blade and the photoreceptor and cause crack on the photoreceptor. In contrast, an increase in the amount of fine particles tends to alleviate the closest-packing. Although the fine particles themselves have such particle diameters that make it difficult to perform the cleaning, a scraping property at the cleaning unit may be secured by using the specific silica particles. In addition, it is effective to use vinyl resin to prevent crack on the photoreceptor. Toner particles that do not contain vinyl resin (toner particles containing polyester resin, for example) are soft and easily collapsed at the cleaning blade portion. In contrast, use of vinyl resin enables hardening of the toner particles themselves, which effectively affects occurrence of crack on the photoreceptor due to the collapse of the toner containing the external additive at the cleaning blade.

The toner obtained by externally adding the specific silica particles to the toner particles with such features exhibits an effect that the external additive is dispersed in a substantially uniform state and the externally added structure may be maintained. The reason is inferred as follows. Since fumed silica particles, for example, have wide particle diameter distribution and cause a large amount of aggregation, the fumed silica particles are localized and it is difficult to externally add the fumed silica particles in a substantially uniform state even if the fumed silica particles are externally added to the toner particles in the related art. In a case of an external additive that has narrow particle diameter distribution and causes a small amount of aggregation, such as sol-gel silica particles, it is possible to disperse the external additive in a substantially uniform state immediately after the external addition. However, in a case where the toner particles have almost spherical shapes and the external additive also has an almost spherical shape, the external additive easily rolls over the toner particles and flaking tends to increase. In contrast, the specific silica particles may maintain the externally added structure even on the surfaces of smooth toner particles with almost spherical shapes while securing dispersibility of the sol-gel silica particles.

It is inferred that the toner according to the exemplary embodiment exhibits the excellent charge holding property and prevents crack on the photoreceptor when the same image is repeatedly formed for the above reasons.

In the toner according to the exemplary embodiment, the specific silica particles further preferably have a particle dispersion degree from 90% to 100%.

Here, description will be given of meaning that the particle dispersion degree of the specific silica particles is from 90% to 100%.

The particle dispersion degree is an index indicating dispersibility of the silica particles. The index is represented by how easily the silica particles in a primary particle state are dispersed in the toner particles. Specifically, the particle dispersion degree is represented by a ratio (actually measured coverage C/calculated coverage $C_0$) between an actually measured coverage C on an attachment target and a calculated coverage $C_0$, where $C_0$ represents the calculated coverage of the silica particles on the surfaces of the toner particles and C represents the actually measured coverage.

Therefore, a higher particle dispersion degree represents that the silica particles do not easily aggregate and tend to be dispersed in the primary particle state in the toner particles. A method of calculating the particle dispersion degree will be described later in detail.

The specific silica particles exhibit further satisfactory dispersibility in the toner particles by controlling the compression aggregation degree and the particle compression ratio within the above ranges and controlling the particle dispersion degree to be as high as 90% to 100%. In doing so, the fluidity of the toner particles themselves are further enhanced, and also, the high fluidity tends to be maintained. As a result, the specific silica particles further tend to adhere to the surfaces of the toner particles in a substantially uniform state, and the deterioration of the charge holding property tends to be prevented.

Preferable examples of the specific silica particles that have the above characteristics, namely the high fluidity, the high dispersibility in the toner particles, the high cohesion, and the high adhesion to the toner particles in the toner according to the exemplary embodiment include silica particles with surfaces to which a siloxane compound with a relatively large weight average molecular weight adheres. Specifically, preferable examples thereof include silica particles having a siloxane compound having a viscosity of 1,000 cSt to 50,000 cSt attached on the surface thereof (preferably, the surface attachment amount of the siloxane compound is from 0.01% by weight to 5% by weight). The specific silica particles are obtained by a method of treating surfaces of silica particles with the siloxane compound having a viscosity of from 1,000 cSt to 50,000 cSt such that the surface attachment amount is from 0.01% by weight to 5% by weight.

Here, the surface attachment amount is a rate with respect to silica particles (untreated silica particles) before the surfaces of the silica particles are treated. Hereinafter, the silica particles before the surface treatment (that is, the untreated silica particles) will also be simply referred to as "silica particles".

According to the specific silica particles obtained by treating the surfaces of silica particles by using the siloxane compound with viscosity from 1,000 cSt to 50,000 cSt such that the surface attachment amount is from 0.01% by weight to 5% by weight, the cohesion and the adhesion to the toner particles are enhanced as well as the fluidity and the dispersibility in the toner particles, and the compression aggregation degree and the particle compression ratio tend to satisfy the above requirements. In addition, the deterioration of the charge holding property and the crack on the photoreceptor tend to be prevented. This is considered to be caused by the following reasons though not clear.

If a small amount of siloxane compound with relatively high viscosity within the above range is made to adhere to surfaces of silica particles at an amount within the above range, then a function derived from properties of the siloxane compound on the surfaces of the silica particles appears. Although the mechanism is not clear, a release property derived from the siloxane compound tends to occur by the small amount of siloxane compound with the relatively high viscosity adhering to the silica particles within the above range, or adhesion between the silica particles is reduced by a decrease in force between the particles due to steric hindrance of the siloxane compound when the silica particles flow. Therefore, the fluidity of the silica particles and the dispersibility in the toner particles are further enhanced.

In contrast, when the silica particles are pressurized, long molecular chains of the siloxane compound on the surfaces of the silica particles get entangled, a closest packed property of the silica particles is enhanced, and aggregation between the silica particles is strengthened. The cohesive force of the silica particles caused by the long molecular chains of the siloxane compound being entangled is considered to be released if the silica particles are made to flow. In addition, the long molecular chains of the siloxane compound on the surfaces of the silica particles enhance adhesion force to the toner particles.

As described above, according to the specific silica particles obtained by causing the small amount of siloxane compound with the viscosity within the above range to adhere to the surfaces of the silica particles at an amount within the above range, the compression aggregation degree and the particle compression ratio tend to satisfy the above requirements, and the particle dispersion degree tends to satisfy the above requirement.

Hereinafter, detailed description will be given of a configuration of the toner.

Toner Particles

The toner particles contain a binder resin, for example. The toner particles may contain a coloring agent, a release agent, other additives, and the like as needed.

Binder Resin

Vinyl resin is applied as the binder resin. Examples of the vinyl resin include a vinyl resin such as homopolymer of a polymerizable monomer or a copolymer of two or more kinds of polymerizable monomers such as styrene polymerizable monomer (such as styrene, parachlorostyrene, or α-methylstyrene), (meth)acryl polymerizable monomer (such as (meth)acrylic acid, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, or 2-ethylhexyl methacrylate), ethylenically unsaturated nitrile polymerizable monomer (such as acrylonitrile, or methacrylonitrile), vinyl ether polymerizable monomer (such as vinyl methyl ether, or vinyl isobutyl ether), vinyl ketone polymerizable monomer (vinyl methyl ketone, vinyl ethyl ketone, or vinyl isopropenyl ketone), or olefin polymerizable monomer (such as ethylene, propylene, or butadiene).

As the binder resin other than vinyl resin, non-vinyl resin such as epoxy resin, polyester resin, polyurethane resin, polyamide resin, cellulose resin, polyether resin, or modified rosin, a mixture of such non-vinyl resin and the vinyl resin, and graft polymer obtained by polymerizing vinyl monomer in presence of the non-vinyl resin may be used together. However, the amount of vinyl resin is preferably equal to or greater than 50% by weight (more preferably 80% by weight, further preferably equal to or greater than 90% by weight) with respect to the entire binder resin.

One kind or two or more kinds of such binder resin may be used alone or in combination.

Preferable examples of vinyl resin from among these examples include styrene (meth)acrylic resin.

The styrene (meth)acrylic resin is copolymer obtained by copolymerizing at least styrene polymerizable monomer (polymerizable monomer having a styrene skeleton) with (meth)acryl polymerizable monomer (polymerizable monomer having a (meth)acryloyl skeleton).

"(Meth)acryl" is an expression including both "acryl" and "methacryl".

Examples of the styrene polymerizable monomer include styrene, alkyl-substituted styrene (such as α-methylstyrene, 2-methylstyrene, 3-methylstyrene, 4-methylstyrene, 2-ethylstyrene, 3-ethylstyrene, or 4-ethylstyrene), halogen-substituted styrene (such as 2-chlorostyrene, 3-chlorostyrene, or 4-chlorostyrene), and vinylnaphthalene. One kind or two kinds or more of styrene polymerizable monomer may be used alone or in combination.

From among these examples, styrene is preferably used as the styrene monomer in terms of reactivity, easiness of reaction control, and availability.

Examples of (meth)acryl polymerizable monomer include (meth)acrylic acid and (meth)acrylic acid ester. Examples of (meth)acrylic acid ester include (meth)acrylic acid alkyl ester (such as methyl (meth)acrylate, ethyl (meth)acrylate, n-propyl (meth)acrylate, n-butyl (meth)acrylate, n-pentyl (meth)acrylate, n-hexyl acrylate, n-heptyl (meth)acrylate, n-octyl (meth)acrylate, n-decyl (meth)acrylate, n-dodecyl (meth)acrylate, n-lauryl (meth)acrylate, n-tetradecyl (meth) acrylate, n-hexadecyl (meth)acrylate, n-octadecyl (meth) acrylate, isopropyl (meth)acrylate, isobutyl (meth)acrylate, t-butyl (meth)acrylate, isopentyl (meth)acrylate, amyl (meth)acrylate, neopentyl (meth)acrylate, isohexyl (meth) acrylate, isoheptyl (meth)acrylate, isooctyl (meth)acrylate, 2-ethylhexyl (meth)acrylate, cyclohexyl (meth)acrylate, or t-butylcyclohexyl (meth)acrylate), (meth)acrylic acid aryl ester (such as phenyl (meth)acrylate, biphenyl (meth)acrylate, diphenylethyl (meth)acrylate, t-butylphenyl (meth) acrylate, or terphenyl (meth)acrylate), dimethylaminoethyl (meth)acrylate, diethylaminoethyl (meth)acrylate, methoxyethyl (meth)acrylate, 2-hydroxyethyl (meth)acrylate, β-carboxyethyl (meth)acrylate, and (meth)acrylamide. One kind or two or more kinds of (meth)acrylic acid polymerizable monomer may be used alone or in combination.

A copolymerization ratio (based on weight; styrene polymerizable monomer/(meth)acryl polymerizable monomer) between the styrene polymerizable monomer and the (meth)acryl polymerizable monomer is preferably from 85/15 to 70/30, for example.

The styrene (meth)acrylic resin may have a crosslinked structure. Examples of the styrene (meth)acrylic resin having a crosslinked structure include a crosslinked product obtained by copolymerizing at least styrene polymerizable monomer, (meth)acrylic acid polymerizable monomer, and crosslinkable monomer, for example.

Examples of the crosslinkable monomer include a difunctional crosslinking agent.

Examples of the difunctional crosslinking agent include divinylbenzene, divinylnaphthalene, a di(meth)acrylate compound (such as diethylene glycol di(meth)acrylate, methylene bis(meth)acrylamide, decanediol diacrylate, or glycidyl (meth)acrylate), polyester-type di(meth)acrylate, and 2-([1'-methylpropylideneamino] carboxyamino) ethyl methacrylate.

Examples of polyfunctional crosslinking agent include a tri(meth)acrylate compound (such as pentaerythritol tri (meth)acrylate, trimethylolethane tri(meth)acrylate, or trimethylolpropane tri(meth)acrylate), a tetra(meth)acrylate compound (such as tetramethylolmethane tetra(meth)acrylate, or oligoester (meth)acrylate), 2,2-bis(4-methacryloxy, polyethoxyphenyl) propane, diallylphthalate, triallyl cyanurate, triallyl isocyanurate, triallyl trimellitate, and diaryl chlorendate.

A copolymerization ratio (based on weight; crosslinkable monomer/entire monomer) of the crosslinkable monomer with respect to the entire monomer is preferably from 2/1,000 to 30/1,000.

The glass transition temperature (Tg) of the styrene (meth)acrylic resin is preferably from 50° C. to 75° C., more preferably from 55° C. to 65° C., and further preferably from 57° C. to 60° C., for example, in terms of the fixing property.

The glass transition temperature is determined by a DSC curve obtained by a differential scanning calorimetry (DSC). More specifically, the glass transition temperature is determined based on "Extrapolation glass transition onset temperature" described in how to determine glass transition temperature in JIS K 7121-1987 "Testing methods for transition temperatures of plastics".

The weight average molecular weight of styrene (meth) acrylic resin is preferably from 30,000 to 200,000, more preferably from 40,000 to 100,000, and further preferably from 50,000 to 80,000, for example, in terms of storage stability.

The weight average molecular weight is measured by gel permeation chromatography (GPC). The molecular weight measurement by the GPC is performed by using GPC.HLC-8120GPC manufactured by Tosoh Corporation as a measurement apparatus, a column TSKgel SuperHM-M (15 cm) manufactured by Tosoh Corporation, and a THF solvent. The weight average molecular weight is calculated by using a molecular weight calibration curve created by a monodispersed polystyrene standard sample from the measurement result.

The content of the binder resin is preferably from 40% by weight to 95% by weight, more preferably from 50% by weight to 90% by weight, and further preferably from 60% by weight to 85% by weight with respect to the entire toner particles, for example.

Coloring Agent

Examples of coloring agent include various pigments such as carbon black, chrome yellow, hansa yellow, benzidine yellow, threne yellow, quinoline yellow, pigment yellow, permanent orange GTR, pyrazolone orange, vulcan orange, watchung red, permanent red, brilliant carmine 3B, brilliant carmine 6B, du pont oil red, pyrazolone red, lithol red, rhodamine B lake, lake red C, pigment red, rose Bengal, aniline blue, ultramarine blue, calco oil blue, methylene blue chloride, phthalocyanine blue, pigment blue, phthalocyanine green, and malachite green oxalate or various dyes such as an acridine dye, a xanthene dye, an azo dye, a benzoquinone dye, an azine dye, an anthraquinone dye, a thioindigo dye, a dioxazine dye, a thiazine dye, an azomethine dye, an indigo dye, a phthalocyanine dye, an aniline black dye, a polymethine dye, a triphenylmethane dye, a diphenylmethane dye, and a thiazol dye.

One kind or two or more kinds of the coloring agents may be used alone or in combination.

As the coloring agent, a surface-treated coloring agent may be used as needed, or a coloring agent may be used along with a dispersant. Multiple coloring agents may be used together.

The content of the coloring agent is preferably from 1% by weight to 30% by weight, and more preferably from 3% by weight to 15% by weight with respect to the entire toner particles, for example.

Release Agent

Examples of the release agent include hydrocarbon wax; natural wax such as carnauba wax, rice wax, or candelilla wax; synthesized or mineral.petroleum wax such as montan wax; and ester wax such as fatty acid ester or montanic acid ester. The release agent is not limited thereto.

The melting temperature of the release agent is preferably from 50° C. to 110° C., and more preferably from 60° C. to 100° C.

The melting temperature is obtained based on "Melting peak temperature" described in how to obtain a melting temperature in JIS K 7121-1987 "Testing methods for transition temperatures of plastics" from a DSC curve obtained by a differential scanning calorimetry (DSC).

The content of the release agent is preferably from 1% by weight to 20% by weight, and more preferably from 5% by weight to 15% by weight with respect to the entire toner particles, for example.

Other Additives

Examples of other additives include known additives such as a magnetic material, a charge-controlling agent, and inorganic powder. Such additives are contained in the toner particles as internal additives.

Properties of Toner Particles

The toner particles may be toner particles with a single layer structure or may be toner particles with a so-called core-shell structure formed of a core (core particle) and a covering layer (shell layer) covering the core.

Here, the toner particles with the core-shell structure is preferably formed of a core including a binder resin, and if necessary, other additives such as a coloring agent and a release agent and a covering layer including a binder resin, for example.

The volume average particle diameter (D50v) of the toner particles is preferably from 2 μm to 10 μm, and more preferably from 4 μm to 8 μm.

As for the number-particle diameter distribution index (lower GSD) on the small diameter side of the toner particles, the toner particles have particle diameter distribution of 1.22 or more. The number-particle diameter distribution index (lower GSD) in the particle diameter distribution of the toner particles is preferably equal to or less than 1.5 and more preferably equal or less than 1.4 in terms of a rate of the amount of fine particles at which the effects of the specific silica may be exhibited. If the number-particle diameter distribution index is greater than the range, defect in image quality such as fogging occurs during the development in some cases.

The volume average particle diameter and particle diameter distribution index of the toner particles are measured by using a COULTER MULTISIZER II (manufactured by Beckman Coulter, Inc.) and ISOTON-II (manufactured by Beckman Coulter, Inc.) as an electrolyte.

For the measurement, 0.5 mg to 50 mg of a measurement sample is added to 2 ml of 5% aqueous solution of a surfactant (preferably sodium alkylbenzene sulfonate) as a dispersant. This mixture is added to 100 ml to 150 ml of electrolyte.

The electrolyte in which the sample is suspended is subjected to dispersion processing by an ultrasonic disperser for 1 minute, and particle diameter distribution of the particles with particle diameters within a range from 2 μm to 60 μm is measured by using an aperture with an aperture diameter of 100 μm by a COULTER MULTISIZER II. The number of particles to be sampled is 50,000.

Cumulative distribution of the volume and the number are depicted from the smaller diameter side, respectively, in the particle diameter range (channel) divide based on the particle diameter distribution to be measured, the particle diameter corresponding to accumulation of 16% is defined to have a volume particle diameter D16v and a number particle diameter D16p, a particle diameter corresponding to accumulation of 50% is defined to have a volume average particle diameter D50v and a cumulative number average particle diameter D50p, and a particle diameter corresponding to accumulation of 84% is defined to have a volume particle diameter D84v and a number particle diameter D84p.

The volume-particle diameter distribution index (GSDv) is calculated as $(D84v/D16v)^{1/2}$, and the number-particle diameter distribution index (GSDp) is calculated as $(D84p/D16p)^{1/2}$ by using the values. The number-particle diameter distribution index (lower GSD) on the small diameter side is calculated as $(D50p/D16p)^{1/2}$.

The average circularity of the toner particles is from 0.98 to 1.00, and preferably from 0.99 to 1.0. That is, the toner particles preferably have almost spherical shapes.

The average circularity of the toner particles is measured by FPIA-3000 manufactured by Sysmex Corporation. The apparatus employs a scheme of measuring particles dispersed in water, for example, by a flow image analysis method, and the suctioned particle suspension is introduced into a flat sheath flow cell, and a flat sample flow is formed by a sheath solution. The passing particles are captured as a stationary image by a CCD camera through an objective lens by irradiating the sample flow with strobe light. The captured particle image is subjected to two-dimensional image processing, and the circularity is calculated from a projection area and a perimeter. As for the circularity, average circularity is obtained by respectively analyzing at least 4,000 images and performing statistical processing.

Equation: circularity=equivalent circle diameter perimeter/perimeter=$[2\times(A\pi)^{1/2}]/PM$ In the above equation, A represents a projection area, and PM represents a perimeter.

For the measurement, an HPF mode (high resolution mode) is used, and dilution magnification is set to 1.0 fold. For data analysis, a circularity analysis range is set to a range from 0.40 to 1.00 for the purpose of removing measurement noise.

External Additive

External additives include the specific silica particles. The external additives may include external additives other than the specific silica particles. That is, only the specific silica particles may be externally added, or the specific silica particles and other external additives may be externally added to the toner particles.

Specific Silica Particles

Compression Aggregation Degree

Although the compression aggregation degree of the specific silica particles is from 60% to 95%, the compression aggregation degree is preferably from 80% to 95%, and more preferably from 85% to 93% in terms of obtaining satisfactory cohesion of the specific silica particles and satisfactory adhesion to the toner particles and also securing the fluidity and the dispersibility in the toner particles (particularly, in terms of the charge holding property and preventing crack on the photoreceptor).

The compression aggregation degree is calculated by the following method.

A disk-shaped mold with a diameter of 6 cm is filled with 6.0 g of specific silica particles. Then, the mold is compressed with a pressure of 5.0 t/cm2 for 60 seconds by using a compression molding machine (manufactured by Maekawa Testing Machine Co., Ltd.), and the compressed disk-shaped compact of the specific silica particles (hereinafter, referred to a "compact before falling") is obtained. Thereafter, the weight of the compact before falling is measured.

Then, the compact before falling is arranged on a screening mesh with an aperture of 600 μm, and the compact before falling is made to fall by a vibration classifier (manufactured by Tsutsui Scientific Instruments Co., Ltd., model number: VIBRATING MVB-1) under conditions of an amplitude of 1 mm and a vibration time of 1 minute. In doing so, the specific silica particles fall from the compact before falling through the screening mesh, and the compact of the specific silica particles remains on the screening mesh. Thereafter, the weight of the compact of the remaining specific silica particles (hereinafter, referred to as a "compact after falling") is measured.

Then, the compression aggregation degree is calculated from the ratio between the weight of the compact after falling and the weight of the compact before falling by using the following Equation (1).

Compression aggregation degree=(weight of compact after falling/weight of compact before falling)×100 Equation (1)

Particle Compression Ratio

Although the particle compression ratio of the specific silica particles is from 0.20 to 0.40, the particle compression ratio is preferably from 0.23 to 0.38, and more preferably from 0.24 to 0.37 in terms of obtaining satisfactory cohesion of the specific silica particles and satisfactory adhesion to the toner particles and also securing the fluidity and the dispersibility in the toner particles (particularly, in terms of the charge holding property and preventing crack on the photoreceptor).

The particle compression ratio is calculated by the following method.

A loosened apparent specific gravity and a hardened apparent specific gravity of the silica particles are measured by using a powder tester (manufactured by Hosokawa Micron Corporation, model number: PT-S). Then, the particle compression ratio is calculated from a ratio between a difference of the hardened apparent specific gravity and the loosened apparent specific gravity and the hardened apparent specific gravity of the silica particles by using the following Equation (2).

particle compression ratio=(hardened apparent specific gravity−loosened apparent specific gravity)/hardened apparent specific gravity Equation (2)

In addition, the "loosened apparent specific gravity" is a measured value extracted by filling a container with capacity of 100 $cm^3$ with the silica particles and weighing the silica particles, and is a bulk specific gravity in a state where the specific silica particles are made to naturally fall in the container. The "hardened apparent specific gravity" is an apparent specific gravity when degassing is performed from the state of the loosened apparent specific gravity by repeatedly applying impact to (tapping) the bottom of the container 180 times at a stroke length of 18 mm and a tapping speed of 50 times/minute, the specific silica particles are rearranged, and the container is further densely filled.

Particle Dispersion Degree

The particle dispersion degree of the specific silica particles is preferably from 90% to 100%, more preferably from 92% to 100%, and further preferably 100% in terms of obtaining further satisfactory dispersibility in the toner particles (particularly, in terms of the charge holding property).

The particle dispersion degree is a ratio between the actually measured coverage C on the toner particles and the calculated coverage $C_0$, and is calculated by the following Equation (3).

$$\text{Particle dispersion degree} = \text{actually measured coverage } C / \text{calculated coverage } C_0 \quad \text{Equation (3)}$$

Here, the calculated coverage $C_0$ of the specific silica particles on the surfaces of the toner particles may be calculated by the following Equation (3-1), where dt (m) represents the volume average particle diameter of the toner particles, da (m) represents the average equivalent circle diameter of the specific silica particles, ρt represents the specific gravity of the toner particles, ρa represents the specific gravity of the specific silica particles, Wt (kg) represents the weight of the toner particles, and Wa (kg) represents the amount of the specific silica particles added.

$$\text{Calculated coverage } C_0 = \sqrt{3}/(2\pi) \times (\rho t/\rho a) \times (dt/da) \times (Wa/Wt) \times 100(\%) \quad \text{Equation (3-1)}$$

The actually measured coverage C of the specific silica particles on the surfaces of the toner particles may be calculated by the following Equation (3-2) by measuring signal intensities of silicon atoms derived from the specific silica particles in only the toner particles, only the specific silica particles, and the toner particles covered with (adhesion) the specific silica particles, respectively, by using an X-ray photoelectron spectroscopy (XPS) ("JPS-9000MX" manufactured by JEOL Ltd.).

$$\text{Actually measured coverage } C = (z-x)/(y-x) \times 100(\%) \quad \text{Equation (3-2)}$$

(In Equation (3-2), x represents the signal intensity of a silicon atom derived from the specific silica particles in only the toner particles. y represents the signal intensity of a silicon atom derived from the specific silica particles in only the specific silica particles. z represents the signal intensity of a silicon atom derived from the specific silica particles in the toner particles covered with (adhesion) the specific silica particles.)

Average Equivalent Circle Diameter

The average equivalent circle diameter of the specific silica particles is preferably from 40 nm to 200 nm, more preferably from 50 nm to 180 nm, and further preferably from 60 nm to 160 nm in terms of obtaining satisfactory fluidity of the specific silica particles, satisfactory dispersibility in the toner particles, satisfactory cohesion, and satisfactory adhesion to the toner particles (particularly, in terms of the charge holding property and preventing the crack on the photoreceptor).

As for the average equivalent circle diameter D50 of the specific silica particles, primary particles after externally adding the specific silica particles to the toner particles are observed by a scanning electron microscope (SEM) (S-4100 manufactured by Hitachi, Ltd.), an image of the primary particles are captured, the image is read by an image analyzer (LUZEXIII manufactured by Nireco Corporation), an area of each particle is measured by image analysis of the primary particles, and the equivalent circle diameter is calculated from the value of area. The 50% diameter (D50) of the obtained cumulative frequency of the equivalent circle diameter based on the volume is regarded as the average equivalent circle diameter D50 of the specific silica particles. The magnification of the electron microscope is set such that from 10 to 50 specific silica particles are viewed in a single field of view, and the equivalent circle diameter of the primary particles is obtained collectively from observation of multiple fields of view.

Average Circularity

Although the shape of the specific silica particles may be any of a spherical shape and an irregular shape, the average circularity of the specific silica particles is preferably from 0.85 to 0.98, more preferably from 0.90 to 0.98, and further preferably from 0.93 to 0.98 in terms of obtaining satisfactory fluidity of the specific silica particles, satisfactory dispersibility in the toner particles, satisfactory cohesion, and satisfactory adhesion to the toner particles (particularly, in terms of the charge holding property and preventing crack on the photoreceptor).

The average circularity of the specific silica particles are measured by the following method.

First, the circularity of the specific silica particles is obtained as "100/SF2" calculated by the following equation in planar image analysis of the primary particles obtained by observing the primary particles after externally adding the silica particles to the toner particles by an SEM apparatus.

$$\text{Equation: circularity}(100/SF2) = 4\pi \times (A/I^2)$$

In the equation, I represents a perimeter of the primary particles on the image, and A represents a projection area of the primary particles.

The average circularity of the specific silica particles is obtained as 50% circularity of the cumulative frequency of circularity of 100 primary particles obtained in the planar image analysis.

Here, a method of measuring the respective properties (the compression aggregation degree, the particle compression ratio, the particle dispersion degree, and the average circularity) of the specific silica particles in the toner will be described.

First, the external additive (specific silica particles) are separated from the toner as follows. The external additive may be separated from the toner particles by dispersing the toner in methanol, stirring the mixture, and treating the mixture with an ultrasonic bath. How easily the external additive may be separated depends on the particle diameter and the specific gravity of the external additive, and it is possible to separate only the specific silica particles by setting an ultrasonic processing condition to be weak since the specific silica particles, which have large diameters in many cases, are easily separated. Next, the external additive of particles with an intermediate diameter and a small diameter may be flaked from the surfaces of the toner particles by changing the ultrasonic processing condition to be strong. The specific silica particles may be extracted by performing this operation every time, precipitating the toner particles by centrifugation, collecting only methanol in which the external additive is dispersed, and then volatilizing methanol. It is necessary to adjust the ultrasonic processing condition in accordance with the particle diameter of the specific silica particles. Then, the separated specific silica particles are used to measure the respective properties.

Hereinafter, detailed description will be given of a configuration of the specific silica particles.

Specific Silica Particles

The specific silica particles are particles that contain silica (that is $SiO_2$) as a main component, and may be crystalline particles or amorphous particles. The specific silica particles may be particles prepared by using a silicon compound, such as water glass or alkoxysilane, as a raw material or may be particles obtained by pulverizing quartz.

Specific examples of the specific silica particles include silica particles prepared by a sol-gel method (hereinafter, referred to as "sol-gel silica particles"), aqueous colloidal silica particles, alcoholic silica particles, fumed silica particles obtained by a gas-phase method, and melted silica particles. From among these examples, the sol-gel silica particles are preferably used.

Surface Treatment

The surfaces of the specific silica particles are preferably treated with a siloxane compound to set the compression aggregation degree, the particle compression ratio, and the particle dispersion degree within the specific ranges.

As a method of the surface treatment, the surfaces of the silica particles are preferably treated in supercritical carbon dioxide by using supercritical carbon dioxide. The method of the surface treatment will be described later.

Siloxane Compound

The siloxane compound is not particularly limited as long as the siloxane compound has a siloxane skeleton in a molecule structure.

Examples of the siloxane compound include silicone oil and silicone resin. From among these examples, silicone oil is preferably used in terms of treating the surfaces of the silica particles in a substantially uniform state.

Examples of the silicone oil include dimethyl silicone oil, methyl hydrogen silicone oil, methylphenyl silicone oil, amino-modified silicone oil, epoxy-modified silicone oil, carboxyl-modified silicone oil, carbinol-modified silicone oil, methacryl-modified silicone oil, mercapto-modified silicone oil, phenol-modified silicone oil, polyether-modified silicone oil, methylstyryl-modified silicone oil, alkyl-modified silicone oil, higher fatty acid ester-modified silicone oil, higher fatty acid amide-modified silicone oil, and fluorine-modified silicone oil. From among these examples, dimethyl silicone oil, methyl hydrogen silicone oil, and amino-modified silicone oil are preferably used.

One kind or two or more kinds of the siloxane compounds may be used alone or in combination.

Viscosity

The viscosity (kinematic viscosity) of the siloxane compound is preferably from 1,000 cSt to 50,000 cSt, more preferably from 2,000 cSt to 30,000 cSt, and further preferably from 3,000 cSt to 10,000 cSt in terms of obtaining satisfactory fluidity of the specific silica particles, satisfactory dispersibility in the toner particles, satisfactory cohesion, and satisfactory adhesion to the toner particles (particularly, in terms of the charge holding property and preventing crack on the photoreceptor).

The viscosity of the siloxane compound is obtained by the following procedure. Toluene is added to the specific silica particles and is dispersed by an ultrasonic disperser for 30 minutes. Thereafter, supernatant is collected. At this time, a toluene solution of the siloxane compound with a concentration of 1 g/100 ml is obtained. At this time, specific viscosity $[\eta_{sp}]$ (25° C.) is obtained by the following Equation (A).

$$\eta_{sp}=(\eta/\eta_0)-1 \qquad \text{Equation (A)}$$

($\eta_0$: viscosity of toluene, $\eta$: viscosity of solution) Next, the specific viscosity $[\eta_{sp}]$ is substituted into a relational expression of Huggins represented as the following Equation (B), and intrinsic viscosity $[\eta]$ is obtained.

$$\eta_{sp}=[\eta]+K'[\eta]^2 \qquad \text{Equation (B)}$$

(K': constant of Huggins, K'=0.3 (when $[\eta]$=1 to 3 is adapted))

Next, the intrinsic viscosity $[\eta]$ is substituted into the equation of A. Kolorlov represented as the following Equation (C), and a molecular weight M is obtained.

$$[\eta]=0.215\times10^{-4}\,M^{0.65} \qquad \text{Equation (C)}$$

The molecular weight M is substituted into the equation of A. J. Barry represented as the following Equation (D), and viscosity $[\eta]$ of siloxane is obtained.

$$\text{Equation } (D)=\log\eta=1.00+0.0123\,M^{0.5}$$

Surface Attachment Amount

The surface attachment amount of the siloxane compound to the surfaces of the specific silica particles is preferably from 0.01% by weight to 5% by weight, more preferably from 0.05% by weight to 3% by weight, and further preferably from 0.10% by weight to 2% by weight with respect to the silica particles (the silica particles before the surface treatment) in terms of obtaining satisfactory fluidity of the specific silica particles, satisfactory dispersibility in the toner particles, satisfactory cohesion, and satisfactory adhesion to the toner particles (particularly, in terms of the charge holding property and preventing crack on the photoreceptor).

The surface attachment amount is measured by the following method.

100 mg of specific silica particles are dispersed in 1 mL of chloroform, 1 μL of N,N-dimethylformamide (DMF) as an internal standard solution is added, the mixture is then subjected to ultrasonic processing for 30 minutes by an ultrasonic washing machine, and the siloxane compound is extracted to a chloroform solvent. Thereafter, hydrogen nuclear spectrum measurement is performed by using a JNM-AL400 nuclear magnetic resonator (manufactured by JEOL Ltd.), and the amount of the siloxane compound is obtained from a ratio of a siloxane compound-derived peak area with respect to a DMF-derived peak area. Then, the surface attachment amount is obtained from the amount of the siloxane compound.

Here, the surfaces of the specific silica particles are preferably treated with the siloxane compound with viscosity from 1,000 cSt to 50,000 cSt, and the surface attachment amount of the siloxane compound to the surfaces of the silica particles is preferably from 0.01% by weight to 5% by weight.

By satisfying the above requirements, the specific silica particles with satisfactory fluidity and satisfactory dispersibility in the toner particles and also with an enhanced cohesion and enhanced adhesion to the toner particles tend to be obtained.

External Additive Amount

The external additive amount (content) of the specific silica particles is preferably from 0.05% by weight to 6.0% by weight, more preferably from 0.22% by weight to 5.0% by weight, and further preferably from 0.3% by weight to 4.0% by weight with respect to the toner particles in terms of the charge holding property of the toner and preventing crack on the photoreceptor.

Preparing Method of Specific Silica Particles

The specific silica particles are obtained by treating the surfaces of the silica particles with the siloxane compound with viscosity from 1,000 cSt to 50,000 cSt such that the surface attachment amount to the silica particles is from 0.01% by weight to 5% by weight.

According to the preparing method of the specific silica particles, silica particles with satisfactory fluidity and satisfactory dispersibility in the toner particles and also with an enhanced cohesion and enhanced adhesion to the toner particles are obtained.

Examples of the surface treatment method include a method of treating the surfaces of the silica particles with the siloxane compound in supercritical carbon dioxide; and a method of treating the surfaces of the silica particles with the siloxane compound in the atmospheric air.

Specific examples of the surface treatment method include: a method of using supercritical carbon dioxide to dissolve the siloxane compound therein and cause the siloxane compound to adhere to the surfaces of the silica particles; a method of applying (spraying or coating, for example) a solution that contains the siloxane compound and a solvent for dissolving the siloxane compound therein to the surfaces of the silica particles in the atmospheric air and causing the siloxane compound to adhere to the surfaces of the silica particles; and a method of adding a solution containing the siloxane compound and a solvent for dissolving the siloxane compound therein to a silica particle dispersion and holding the mixture in the atmospheric air, and then drying the mixture solution of the silica particle dispersion and the solution.

From among these examples, the method of using supercritical carbon dioxide to cause the siloxane compound to adhere to the surfaces of the silica particles is preferably used as the surface treatment method.

If the surface treatment is performed in supercritical carbon dioxide, then a state where the siloxane compound is dissolved in supercritical carbon dioxide is obtained. It is considered that since supercritical carbon dioxide has a low surface tension, the siloxane compound in the state of being dissolved in supercritical carbon dioxide tend to be diffused and reach deep portions of pores on the surfaces of the silica particles along with supercritical carbon dioxide and the surface treatment with the siloxane compound affects not only the surfaces of the silica particles but also the deep portions of the pores.

Therefore, it is considered that the silica particles surface-treated with the siloxane compound in supercritical carbon dioxide become silica particles surface-treated with the siloxane compound in substantially uniform state (such as a state where a surface treated layer is formed in a thin film shape).

In the preparing method of the specific silica particles, surface treatment for applying hydrophobicity to the surfaces of the silica particles may be performed by using a hydrophobizing agent along with the siloxane compound in supercritical carbon dioxide.

In such a case, it is considered that a state where the hydrophobizing agent is dissolved along with the siloxane compound in supercritical carbon dioxide is obtained, the siloxane compound and the hydrophobizing agent in the state being dissolved in supercritical carbon dioxide tend to be diffused and reach the deep portions of the pores on the surfaces of the silica particles, along with supercritical carbon dioxide, and the surface treatment with the siloxane compound and the hydrophobizing agent affects not only the surfaces of the silica particles but also the deep portions of the pores.

As a result, the silica particles surface-treated with the siloxane compound and the hydrophobizing agent in supercritical carbon dioxide have substantially uniform surfaces treated with the siloxane compound and the hydrophobizing agent, and also, high hydrophobicity tends to be applied thereto.

In the preparing method of the specific silica particles, supercritical carbon dioxide may be used in other preparation processes (such as a solvent removing process) of the silica particles.

Examples of the preparing method of the specific silica particles using supercritical carbon dioxide in other preparation processes include a preparing method of the silica particles including a process for preparing a silica particle dispersion that contains silica particles and a solvent containing alcohol and water by a sol-gel method (hereinafter, referred to as a "dispersion preparation process"), a process for distributing supercritical carbon dioxide and removing the solvent from the silica particle dispersion (hereinafter, referred to as a "solvent removing process"), and a process for treating surfaces of the silica particles after removing the solvent with the siloxane compound in supercritical carbon dioxide (hereinafter, referred to as a "surface treatment process").

If the solvent is removed from the silica particle dispersion by using supercritical carbon dioxide, formation of coarse particles tends to be prevented.

This is considered to be 1) because in a case of removing the solvent in the silica particle dispersion, a characteristic of supercritical carbon dioxide that "surface tension does not work" enables the removal of the solvent without causing aggregation between the particles due to liquid bridging force during the removal of the solvent, and 2) because a characteristic that supercritical carbon dioxide "is carbon dioxide in a state under a temperature and a pressure of equal to or greater than critical points and has both a gas diffusing property and a liquid dissolving property" enables effective contact to supercritical carbon dioxide at a relatively low temperature (equal to or lower than 250° C., for example) and dissolving of the solvent, and thus enables the removal of the solvent in the silica particle dispersion without forming coarse particles such as secondary aggregates due to condensation of a silanol group by removing supercritical carbon dioxide with the solvent dissolved therein, though not clear.

Here, although the solvent removing process and the surface treatment process may be individually performed, it is preferable that the solvent removing process and the surface treatment process are successively performed (that is, the respective processes are performed in a state of being not opened to the atmospheric pressure). If the respective processes are successively performed, there is no opportunity that the silica particles adsorb humidity after the solvent removing process, and the surface treatment process may be performed in a state where excessive humidity adsorption by the silica particles is prevented. In doing so, it is not necessary to use a large amount of siloxane compound and to perform the solvent removing process and the surface treatment process at a high temperature by performing excessive heating. As a result, formation of coarse particles tend to be prevented more effectively.

Hereinafter, detailed description will be given of the respective processes for details of the preparing method of the specific silica particles.

The preparing method of the specific silica particles is not limited thereto, and 1) a configuration in which supercritical carbon dioxide is used only in the surface treatment process or 2) a configuration in which the respective processes are individually performed, for example, may be employed.

Hereinafter, detailed description will be given of the respective processes.

Dispersion Preparation Process

In a dispersion preparation process, a silica particle dispersion containing silica particles and a solvent that contains alcohol and water is prepared, for example.

Specifically, the silica particle dispersion is prepared by a wet method (such as a sol-gel method), for example, and is prepared in the dispersion preparation process. In particular, the silica particle dispersion is preferably prepared by a sol-gel method as a wet method, specifically by causing a reaction (a hydrolysis reaction or a condensation reaction) of tetraalkoxysilane in a solvent of alcohol and water in presence of an alkali catalyst to form silica particles.

The preferable range of the average equivalent circle diameter and the preferable range of the average circularity of the silica particles are as described above.

In the case of obtaining the silica particles by the wet method, for example, in the dispersion preparation process, a dispersion (silica particle dispersion) in which the silica particles are dispersed in the solvent is obtained.

Here, the weight ratio of water with respect to alcohol in the prepared silica particle dispersion is preferably from 0.05 to 1.0, more preferably from 0.07 to 0.5, and further preferably from 0.1 to 0.3 at the timing of moving on to the solvent removing process.

If the weight ratio of water with respect to alcohol in the silica particle dispersion is set within the above range, the amount of coarse silica particles formed after the surface treatment is small, and silica particles with satisfactory electric resistance tend to be obtained.

If the weight ratio of water with respect to alcohol is less than 0.05, condensation of silanol groups on the surfaces of the silica particles during removal of the solvent is reduced in the solvent removing process. Therefore, the amount of humidity adsorbed by the surfaces of the silica particles after the removal of the solvent increases, and the electric resistance of the silica particles after the surface treatment becomes excessively low in some cases. If the weight ratio of water is greater than 1.0, a large amount of water remains near the end of the removal of the solvent from the silica particle dispersion in the solvent removing process, aggregation between the silica particles due to liquid bridging force tends to occur, and coarse particles are present after the surface treatment in some cases.

The weight ratio of water with respect to the silica particles in the prepared silica particle dispersion is preferably from 0.02 to 3, more preferably from 0.05 to 1, and further preferably from 0.1 to 0.5, for example, at the timing of moving on to the solvent removing process.

If the weight ratio of water with respect to the silica particles in the silica particle dispersion is set within the above range, the amount of coarse silica particles formed is small, and silica particles with satisfactory electric resistance tend to be obtained.

If the weight ratio of water with respect to the silica particles is less than 0.02, condensation of silanol groups on the surface of the silica particles during the removal of the solvent is significantly reduced in the solvent removing process. Therefore, the amount of humidity adsorbed by the surfaces of the silica particles after the removal of the solvent increases, and the electric resistance of the silica particles becomes excessively low in some cases.

If the weight ratio of water is greater than 3, a large amount of water remains near the end of the removal of the solvent from the silica particle dispersion in the solvent removing process, and aggregation between the silica particles due to the liquid bridging force tends to occur.

The weight ratio of the silica particles with respect to the silica particle dispersion in the prepared silica particle dispersion is preferably from 0.05 to 0.7, more preferably from 0.2 to 0.65, and further preferably from 0.3 to 0.6 at the timing of moving on to the solvent removing process.

If the weight ratio of the silica particles with respect to the silica particle dispersion is less than 0.05, the amount of supercritical carbon dioxide used in the solvent removing process increases, and productivity deteriorates in some cases.

If the weight ratio of the silica particles with respect to the silica particle dispersion is greater than 0.7, the distances between silica particles decreases in the silica particle dispersion, and coarse silica particles due to aggregation and gelatinization tend to occur in some cases.

Solvent Removing Process

The solvent removing process is a process for distributing supercritical carbon dioxide and removing the solvent from the silica particle dispersion, for example.

That is, the solvent removing process is a process of removing the solvent by distributing supercritical carbon dioxide and bringing supercritical carbon dioxide into contact with the silica particle dispersion.

Specifically, the silica particle dispersion is put into a sealed reactor, for example, in the solvent removing process. Thereafter, liquefied carbon dioxide is added to the sealed reactor, the mixture is heated, the pressure in the reactor is boosted by a high-pressure pump, and carbon dioxide is brought into supercritical state. Then, supercritical carbon dioxide is introduced into the sealed reactor, is discharged therefrom, and is thus distributed in the sealed reactor, namely in the silica particle dispersion.

In doing so, supercritical carbon dioxide is discharged to the outside of the silica particle dispersion (outside of the sealed reactor) while the solvent (alcohol and water) dissolves in the supercritical carbon dioxide, so that the solvent is removed.

Here, supercritical carbon dioxide is carbon dioxide in a state under a temperature and a pressure of equal to or greater than critical points and has both a gas diffusing property and a liquid dissolving property.

A temperature condition, namely the temperature of supercritical carbon dioxide during the removal of the solvent is preferably from 31° C. to 350° C., more preferably from 60° C. to 300° C., and further preferably from 80° C. to 250° C., for example.

If the temperature is less than the above range, it becomes difficult for the solvent to be dissolved in supercritical carbon dioxide. Therefore, it becomes difficult to remove the solvent in some cases. In addition, it is considered that coarse particles tend to be formed due to the liquid bridging force of the solvent and supercritical carbon dioxide. In contrast, it is considered that if the temperature is greater than the above range, then coarse particles such as secondary aggregates tend to be formed due to condensation of silanol groups on the surfaces of the silica particles.

A pressure condition, namely a pressure of supercritical carbon dioxide during the removal of the solvent is preferably from 7.38 MPa to 40 MPa, more preferably from 10 MPa to 35 MPa, and further preferably from 15 MPa to 25 MPa, for example.

If the pressure is less than the above range, it tends to be difficult for the solvent to be dissolved in supercritical carbon dioxide. In contrast, if the pressure is greater than the above range, equipment tends to be expensive.

The amount of supercritical carbon dioxide to be introduced to and discharged from the sealed reactor is preferably from 15.4 L/minute/$m^3$ to 1,540 L/minute/$m^3$, and more preferably from 77 L/minute/$m^3$ to 770 L/minute/$m^3$.

If the introduced and discharged amount is less than 15.4 L/minute/$m^3$, it takes long time to remove the solvent. Therefore, the productivity tends to deteriorate.

In contrast, if the introduced and discharged amount is greater than 1,540 L/minute/$m^3$, then short pass of supercritical carbon dioxide occurs, contact time of the silica particle dispersion is reduced, and it tends to become difficult to efficiently remove the solvent.

Surface Treatment Process

The surface treatment process is a process of treating the surfaces of the silica particles with the siloxane compound in supercritical carbon dioxide, which follows the solvent removing process, for example.

That is, in the surface treatment process, the surfaces of the silica particles are treated with the siloxane compound in supercritical carbon dioxide without exposure to the atmospheric air before moving on from the solvent removing process, for example.

Specifically, in the surface treatment process, the temperature and the pressure in the sealed reactor are adjusted after the introduction and the discharge of the supercritical carbon dioxide to and from the sealed reactor in the solvent removing process is stopped, for example, and the siloxane compound is put into the silica particles at a predetermined rate in the sealed reactor in presence of supercritical carbon dioxide. Then, a reaction of the siloxane compound is caused while the state is maintained, namely in supercritical carbon dioxide, and the surfaces of the silica particles are treated.

Here, it is only necessary the reaction of the siloxane compound is caused in supercritical carbon dioxide (namely, in an atmosphere of supercritical carbon dioxide) in the surface treatment process, and the surface treatment may be performed while supercritical carbon dioxide is distributed (that is, while supercritical carbon dioxide is introduced into and discharged from the sealed reactor), or the surface treatment may be performed without distributing supercritical carbon dioxide.

In the surface treatment process, the amount of silica particles with respect to an inner volume of the reactor (namely, the amount of silica particles fed) is preferably from 30 g/L to 600 g/L, more preferably from 50 g/L to 500 g/L, and further preferably from 80 g/L to 400 g/L, for example.

If the amount is less than the above range, concentration of the siloxane compound with respect to supercritical carbon dioxide decreases, a rate of contact with the silica surfaces decreases, and the reaction tends not to advance in some cases. In contrast, if the amount is greater than the above range, the concentration of the siloxane compound with respect to supercritical carbon dioxide increases, the siloxane compound is not completely dissolved in supercritical carbon dioxide, which brings about a dispersion defect, and coarse aggregates tend to be formed.

The density of supercritical carbon dioxide is preferably from 0.10 g/ml to 0.80 g/ml, preferably from 0.10 g/ml to 0.60 g/ml, and further preferably from 0.2 g/ml to 0.50 g/ml, for example.

If the density is less than the above range, the solubility of the siloxane compound in supercritical carbon dioxide decreases, and aggregates tend to be formed. In contrast, if the density is greater than the above range, the diffusing property in silica pores deteriorates. Therefore, there is a case in which the surface treatment is insufficiently performed. It is preferable to perform the surface treatment within the above density range especially on sol-gel silica particles that contain a large number of silanol groups.

The density of supercritical carbon dioxide is adjusted by a temperature, a pressure, and the like.

Specific examples of the siloxane compound are as described above. Also, the preferable range of the viscosity of the siloxane compound is as described above.

If silicone oil is applied from among the examples of the siloxane compound, the silicone oil tends to adhere to the surfaces of the silica particles in a substantially uniform state, and the fluidity, the dispersibility, and an operability of the silica particles tend to be enhanced.

The amount of siloxane compound used is preferably from 0.05% by weight to 3% by weight, more preferably from 0.1% by weight to 2% by weight, and further preferably from 0.15% by weight to 1.5% by weight with respect to the silica particles, for example, in terms of easily controlling the surface attachment amount with respect to the silica particles within the range from 0.01% by weight to 5% by weight.

The siloxane compound may be used alone, or a solution mixed with a solvent in which the siloxane compound is easily dissolved may be used. Examples of the solvent include toluene, methyl ethyl ketone, and methyl isobutyl ketone.

In the surface treatment process, the surfaces of the silica particles may be treated with a mixture containing the siloxane compound and a hydrophobizing agent.

Examples of the hydrophobizing agent include a silane hydrophobizing agent. Examples of the silane hydrophobizing agent include known silicon compounds having alkyl groups (such as a methyl group, an ethyl group, a propyl group, or a butyl group), and specific examples thereof include a silazane compound (a silane compound such as methyltrimethoxysinale, dimethyldimethoxysilane, trimethylchlorosilane, or trimethylmethoxysilane, hexamethyldisilazane, or tetramethyldisilazane). One kind or multiple kinds of the hydrophobizing agents may be used.

From among the silane hydrophobizing agents, a silicon compound having a trimethyl group, such as trimethylmethoxysilane or hexamethyldisilazane (HMDS), particularly, hexamethyldisilazane (HMDS) is preferably used.

The amount of silane hydrophobizing agent used is not particularly limited, the amount is preferably from 1% by weight to 100% by weight, more preferably from 3% by weight to 80% by weight, and further preferably from 5% by weight to 50% by weight with respect to the silica particles, for example.

The silane hydrophobizing agent may be used alone, or the silane hydrophobizing agent may be used as a solution mixed with a solvent in which the silane hydrophobizing agent is easily dissolved. Examples of the solvent include toluene, methyl ethyl ketone, and methyl isobutyl ketone.

A temperature condition, namely the temperature of supercritical carbon dioxide in the surface treatment is preferably from 80° C. to 300° C., more preferably from 100° C. to 250° C., and further preferably from 120° C. to 200° C.

If the temperature is less than the above range, surface treatment ability of the siloxane compound deteriorates in some cases. In contrast, if the temperature is greater than the above range, a condensation reaction between silanol groups in the silica particles advances, and particle aggregation occurs in some cases. The surface treatment is preferably performed within the above temperature range on sol-gel silica particles that contain a large number of silano groups, in particular.

Although any pressure condition, namely any pressure of supercritical carbon dioxide in the surface treatment may be set as long as the above density is satisfied, the pressure is preferably from 8 MPa to 30 MPa, more preferably from 10 MPa to 25 MPa, and further preferably from 15 MPa to 20 MPa, for example.

The specific silica particles are obtained by the respective processes described above.

Other External Additives

Examples of other external additives include inorganic particles. Examples of the inorganic particles include $SiO_2$ (except for the specific silica particles), $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)n$, $Al_2O_3.2SiO_2$, $CaCO_3$, $MgCO_3$, $BaSO_4$, and $MgSO_4$.

It is preferable that the surfaces of the inorganic particles as other external additive are treated with a hydrophobizing agent. The treatment with the hydrophobizing agent is performed by dipping the inorganic particles in a hydrophobizing agent, for example. Although the hydrophobizing agent is not particularly limited, examples thereof include a silane coupling agent, silicone oil, a titanate coupling agent, and an aluminum coupling agent. One kind or two or more kinds of the hydrophobizing agents may be used alone or in combination.

The amount of the hydrophobizing agent is typically from 1 part by weight to 10 parts by weight with respect to 100 parts by weight of the inorganic particles, for example.

Examples of other external additive also include resin particles (resin particles of polystyrene, polymethyl methacrylate (PMMA), melamine resin, or the like) and a cleaning aid (metal salt of higher fatty acid, representative examples of which include zinc stearate, particles of fluorine high-molecular-weight material).

The amount of the other external additive externally added is preferably from 0.1% by weight to 8.0% by weight, and more preferably from 0.5% by weight to 6.0% by weight with respect to the amount of the toner particles, for example.

Preparing Method of Toner

Next, description will be given of a preparing method of the toner according to the exemplary embodiment.

The toner according to the exemplary embodiment is obtained by preparing the toner particles and then externally adding the external additives to the toner particles.

The toner particles may be prepared by any of dry preparing methods (such as a kneading and pulverizing method) and wet preparing methods (such as a coalescing method, a suspension polymerization method, and a dissolution suspension method) as long as the ranges of the average circularity and the number-particle diameter distribution index (lower GSD) on the small diameter side are satisfied. The preparing method of the toner particles are not particularly limited, and a known method is employed.

It is preferable to obtain the toner particles by the suspension polymerization method from among these methods in terms of obtaining toner particles that satisfy the above ranges of the average circularity and the number-particle diameter distribution index (lower GSD) on the small diameter side.

Specifically, in the case of preparing the toner particles by the suspension polymerization method, the toner particles are prepared by a process (polymerizable monomer composition preparation process) of preparing a polymerizable monomer composition containing at least a polymerizable monomer that becomes a binder resin by polymerization, a process (suspension preparation process) of preparing a suspension by mixing the polymerizable monomer composition and a water dispersion medium, and a process (polymerization process) of forming toner particles by polymerizing the polymerizable monomer in the suspension.

Hereinafter, detailed description will be given of the respective processes. Although a method of obtaining toner particles that contain a coloring agent and a release agent will be described below, the coloring agent and the release agent are used as needed. It is a matter of course that other additives other than the coloring agent and the release agent may be used.

Polymerizable Monomer Composition Preparation Process

In the polymerizable monomer composition preparation process, the polymerizable monomer composition is prepared, for example, by mixing, dissolving, or dispersing the polymerizable monomer that becomes a binder resin by polymerization (polymerizable monomer containing a cross-linkable monomer as needed), the coloring agent, and the release agent. Known additives such as an organic solvent and a polymerization initiator may be mixed, dissolved, or dispersed in the polymerizable monomer composition in addition to the other additives.

The polymerizable monomer composition is prepared by using a mixer such as a homogenizer, a ball mill, or an ultrasonic disperser.

Here, examples of the polymerization initiator include known polymerization initiators such as organic peroxide (such as di-t-butyl peroxide, benzoyl peroxide, t-butylperoxy-2-ethylhexanoate, t-hexylperoxy-2-ethylhexanoate, t-butylperoxy pivalate, diisopropyl peroxy dicarbonate, di-t-butylperoxy isophthalate, or t-butylperoxy isobutyrate), inorganic persulfate (potassium persulfate or ammonium persulfate), and an azo compound (4,4'-azobis(4-cyanovaleric acid), 2,2'-azobis(2-methyl-N-(2-hydroxyethyl) propion amide), 2,2'-azobis(2-amidinopropane) dihydrochloride, 2,2'-azobis(2,4-dimethylvaleronitrile), or 2,2'-azobisisobutyronitrile)).

The content of the polymerization initiator is preferably from 0.1 parts by weight to 20 parts by weight, more preferably from 0.3 parts by weight to 15 parts by weight, and further preferably from 1.0 parts by weight to 10 parts by weight with respect to 100 parts by weight of the polymerizable monomer.

The polymerization initiator may be added to the polymerizable monomer composition, or may be added to an aqueous medium before suspension of the polymerizable monomer composition in the suspension preparation process which will be described below.

Suspension Preparation Process

In the suspension preparing method, the polymerizable monomer composition and the aqueous medium are mixed, the polymerizable monomer composition is suspended in the aqueous medium, and the suspension is prepared, for example. That is, liquid droplets of the polymerizable monomer composition are formed in the aqueous medium.

The suspension is prepared by using a mixer such as a homogenizer, a ball mill, or an ultrasonic disperser.

Here, examples of the aqueous medium include a medium of water alone and a mixed solvent containing water and an aqueous solvent (such as lower alcohol or lower ketone).

The aqueous medium may contain a dispersion stabilizer.

Examples of the dispersion stabilizer include an organic dispersion stabilizer and an inorganic dispersion stabilizer. Examples of the organic dispersion stabilizer include a surfactant (an anionic surfactant, a nonionic surfactant, or an amphoteric surfactant), an aqueous polymer compound (polyvinyl alcohol, methyl cellulose, gelatin), and a sulfate salt. Examples of the inorganic dispersion stabilizer include a sulfate salt (barium sulfate or calcium sulfate), carbonate (barium carbonate, calcium carbonate, or magnesium carbonate), a phosphoric salt (calcium phosphate), metal oxide (aluminum oxide or titanium oxide), and metal hydroxide (such as aluminum hydroxide, magnesium hydroxide, or ferric hydroxide). One kind or two or more kinds of the dispersion stabilizers may be used alone or in combination.

The content of the dispersion stabilizer is preferably from 0.1 parts by weight to 20 parts by weight and more preferably from 0.2 parts by weight to 10 parts by weight with respect to 100 parts by weight of the polymerizable monomer.

Polymerization Process

In the polymerization process, the suspension is heated, the polymerizable monomer is polymerized, and toner particles are formed, for example. That is, in the polymerization process, a binder resin is prepared by polymerizing the polymerizable monomer in the liquid droplets of the polymerizable monomer composition dispersed in the suspension, and the toner particles containing the binder resin, the coloring agent, and the release agent are formed.

Here, the polymerization temperature of the polymerizable monomer is preferably equal to or higher than 50° C., and more preferably from 60° C. to 98° C. The polymerization time of the polymerizable monomer is preferably from 1 hour to 20 hours, and more preferably from 2 hours to 15 hours. The polymerization of the polymerizable monomer is made to advance while the suspension is stirred.

The toner particles are obtained by the processes.

In addition, toner particles with a core-shell structure may be prepared by forming shell layers on the toner particles, which are formed in the polymerization process, as core particles (cores) by a known method such as an insitu polymerization method or a phase separation method. In a case of forming the shell layers by using the insitu polymerization method, resin is prepared so as to cover the surfaces of the core particles by adding (also adding a polymerization initiator as needed) the polymerizable monomer (polymerizable monomer that becomes resin for forming the shell layers) that becomes a binder resin by polymerization to the aqueous medium, in which the core particles are dispersed, which is obtained by the polymerization process, and causing polymerization, and the shell layers are thus formed. In doing so, toner particles with the core-shell structure in which the shell layers are formed on the surfaces of the core particles (cores) are prepared.

Here, the toner particles in a state of being dried after the toner particles formed in the aqueous medium are subjected to a known washing process, a solid-liquid separation process, and a drying process are obtained after completion of the polymerization process.

In the washing process, acid or alkali is preferably added to the aqueous medium, in which the toner particles are dispersed, in order to remove the dispersion stabilizer. Specifically, known acid is added in a case where the dispersion stabilizer used is a compound that is soluble in acid, and known alkali is added in a case where the dispersion stabilizer used is a compound that is soluble in alkali.

Although the solid-liquid separation process is not particularly limited, it is preferable to perform suction filtration, pressurization filtration, or the like in terms of productivity.

Although a method used in the drying process is not particularly limited, it is preferable to perform freeze-drying, flash drying, fluidized drying, or vibration-type fluidized drying in terms of productivity.

The toner according to the exemplary embodiment is prepared by adding the external additive to the obtained toner particles in the dried state and mixing the external additive with the toner particles, for example. It is preferable to perform the mixture by using a V blender, a HENSCHEL mixer, or a LÖEDIGE MIXER, for example. Furthermore, coarse toner particles may be removed by using a vibration classifier, a wind classifier, or the like as needed.

Electrostatic Charge Image Developer

The electrostatic charge image developer according to the exemplary embodiment contains at least the toner according to the exemplary embodiment.

The electrostatic charge image developer according to the exemplary embodiment may be a single-component developer that contains only the toner according to the exemplary embodiment or may be a two-component developer in which the toner is mixed with a carrier.

The carrier is not particularly limited, and known carriers are exemplified. Examples of the carrier include a covered carrier in which the surfaces of cores made of magnetic particles are covered with covering resin; a magnetic particle dispersed-type carrier in which magnetic particles are dispersed and blended in matrix resin; and resin impregnation-type carrier in which porous magnetic particles are impregnated with resin.

The magnetic particle dispersed-type carrier and the resin impregnation-type carrier may be carrier in which constituent particles of the carriers form cores and the surfaces thereof are covered with the covering resin.

Examples of the magnetic particles include magnetic metal such as iron, nickel, or cobalt, and magnetic oxide such as ferrite and magnetite.

Examples of the covering resin and the matrix resin include polyethylene, polypropylene, polystyrene, polyvinyl acetate, polyvinyl alcohol, polyvinyl butyral, polyvinyl chloride, polyvinyl ether, polyvinyl ketone, vinyl chloride-vinyl acetate copolymer, styrene-acrylic acid ester copolymer, or straight silicone resin or modified substances thereof that contain a organosiloxane bond, fluorine resin, polyester, polycarbonate, phenol resin, and epoxy resin.

The covering resin and the matrix resin may contain another additive such as conductive particles.

Examples of the conductive particles include: metal such as gold, silver, or copper; and particles of carbon black, titanium oxide, zinc oxide, tin oxide, barium sulfate, aluminum borate, potassium titanate, or the like.

Here, for covering the surfaces of the cores with the covering resin, a covering method using a solution for forming a covering layer that is obtained by dissolving the covering resin, and if necessary, various additives in an appropriate solvent is exemplified. The solvent is not particularly limited and may be selected in consideration of the covering resin used, application aptitudes, and the like.

Specific examples of the resin covering method include a dipping method of dipping the cores in the solution for forming the covering layer, a spray method of spraying the solution for forming the covering layer to the surfaces of the cores, a fluidized bed method of spraying the solution for forming the covering layer in a state in which the cores are made to float by air flow, and a kneader coater method of mixing the cores of the carrier and the solution for forming the covering layer in a kneader coater and then removing a solvent.

A mixing ratio (weight ratio) between the toner and the carrier in the two-component developer is preferably from toner:carrier=1:100 to 30:100, and more preferably from 3:100 to 20:100.

Image Forming Apparatus/Image Forming Method

Description will be given of an image forming apparatus and an image forming method according to the exemplary embodiment.

The image forming apparatus according to the exemplary embodiment includes an image holding member, a charging unit that charges a surface of the image holding member, an electrostatic charge image forming unit that forms an electrostatic charge image on the charged surface of the image holding member, a developing unit that contains an electrostatic charge image developer and develops the electrostatic charge image formed on the surface of the image holding member as a toner image by using the electrostatic charge image developer, a transfer unit that transfers the toner image formed on the surface of the image holding member to a surface of a recording medium, a cleaning unit that includes a cleaning blade for cleaning the surface of the image holding member, and a fixing unit that fixes the toner image transferred to the surface of the recording medium. The electrostatic charge image developer according to the exemplary embodiment is applied as the electrostatic charge image developer.

The image forming apparatus according to the exemplary embodiment performs the image forming method (the image forming method according to the exemplary embodiment) including a charging process of charging the surface of the image holding member, an electrostatic charge image formation process of forming the electrostatic charge image on the charged surface of the image holding member, a developing process of developing the electrostatic charge image formed on the surface of the image holding member as the toner image by using the electrostatic charge image developer according to the exemplary embodiment, a transfer process of transferring the toner image formed on the surface of the image holding member to the surface of the recording medium, a cleaning process of cleaning the surface of the image holding member by using the cleaning blade, and a fixing process of fixing the toner image transferred to the surface of the recording medium.

As the image forming apparatus according to the exemplary embodiment, a known image forming apparatus such as: a direct transfer-type apparatus that directly transfers the toner image formed on the surface of the image holding member to the recording medium; an intermediate transfer-type apparatus that primarily transfers the toner image formed on the surface of the image holding member to a surface of an intermediate transfer member and secondarily transfers the toner image transferred to the surface of the intermediate transfer member to the surface of the recording image; or an apparatus provided with an erasing unit that erases the charge by irradiating the surface of the image holding member with erasing light before the charging and after the transferring of the toner image is applied.

In a case of the intermediate transfer-type apparatus, a structure including an intermediate transfer member with a surface to which the toner image is transferred, a primary transfer unit that primarily transfers the toner image formed on the surface of the image holding member to the surface of the intermediate transfer member, and a secondary transfer unit that secondarily transfers the toner image transferred to the surface of the intermediate transfer member to the surface of the recording medium, for example, is applied to the transfer unit.

In the image forming apparatus according to the exemplary embodiment, a portion including the developing unit, for example, may have a cartridge structure (process cartridge) that is detachable from the image forming apparatus. As the process cartridge, a process cartridge that contains the electrostatic charge image developer according to the exemplary embodiment and is provided with the developing unit is preferably used.

Hereinafter, an example of the image forming apparatus according to the exemplary embodiment will be shown. However, the image forming apparatus is not limited thereto. In addition, main components illustrated in the drawings will be described, and descriptions of the other components will be omitted.

FIG. 1 is a configuration diagram schematically illustrating the image forming apparatus according to the exemplary embodiment.

The image forming apparatus illustrated in FIG. 1 includes first to fourth image forming units 10Y, 10M, 10C, and 10K (image forming units) based on an electrophotography scheme, which output images of the respective colors, namely yellow (Y), magenta (M), cyan (C), and black (K) based on image data of separated colors. These image forming units (hereinafter, also simply referred to as "units") 10Y, 10M, 10C, and 10K are aligned at a predetermined interval in the horizontal direction. These units 10Y, 10M, 10C, and 10K may be a process cartridge that is detachable from the image forming apparatus.

On the upper side in the drawing of the respective units 10Y, 10M, 10C, and 10K, an intermediate transfer belt 20 as an intermediate transfer member extends through the respective units. The intermediate transfer belt 20 is provided so as to be wound around a drive roller 22 and a support roller 24 in contact with inner surfaces of the intermediate transfer belt 20, which are arranged so as to separate from each other in the direction from the left side to the right side in the drawing, and the intermediate transfer belt 20 travels in the direction from the first unit 10Y toward the fourth unit 10K. Force in a direction away from the drive roller 22 is applied to the support roller 24 by a spring or the like, which is not illustrated in the drawing, and tension force is applied to the intermediate transfer belt 20 wound around both the support roller 24 and the drive roller 22. An intermediate transfer member cleaning device 30 is provided on a surface of the intermediate transfer belt 20 on the side of the image holding member so as to face the drive roller 22.

Toner including four-color toner of yellow, magenta, cyan, and black contained in toner cartridges 8Y, 8M, 8C, and 8K is supplied to the respective developing devices (developing units) 4Y, 4M, 4C, and 4K of the respective units 10Y, 10M, 10C, and 10K.

Since the first to fourth units 10Y, 10M, 10C, and 10K have the same configuration, the first unit 10Y that is disposed on the upstream side in the intermediate transfer belt traveling direction and forms a yellow image will be described as a representative. Descriptions of the second to fourth units 10M, 10C, and 10K will be omitted by applying reference numerals indicating magenta (M), cyan (C), and black (K) instead of yellow (Y) at the same portions in the description of the first unit 10Y.

The first unit 10Y includes a photoreceptor 1Y that acts as an image holding member. In the periphery of the photoreceptor 1Y, a charging roller (an example of the charging unit) 2Y that charges the surface of the photoreceptor 1Y to have a predetermined potential, an exposure device (an example of the electrostatic charge image forming unit) 3 that exposes the charged surface with a laser beam 3Y based on an image signal of a separated color and forms an electrostatic charge image, a developing device (an example of the developing unit) 4Y that supplies charged toner to the electrostatic charge image and develops the electrostatic charge image, a primary transfer roller 5Y (an example of the primary transfer unit) that transfers the developed toner image to the intermediate transfer belt 20, and a photoreceptor cleaning device (an example of the cleaning unit) 6Y that includes a cleaning blade 6Y-1 for removing the toner remaining on the surface of the photoreceptor 1Y after the primary transfer are arranged in order.

The primary transfer roller 5Y is arranged inside the intermediate transfer belt 20 and is provided at such a position that the primary transfer roller 5Y faces the photoreceptor 1Y. Furthermore, bias power sources (not shown) for applying primary transfer biases are connected to the respective primary transfer rollers 5Y, 5M, 5C, and 5K, respectively. The respective bias power sources vary the transfer biases to be applied to the respective primary transfer rollers in response to control by a control unit, which is not shown in the drawing.

Hereinafter, description will be given of operations of forming a yellow image by the first unit 10Y.

First, the charging roller 2Y charges the surface of the photoreceptor 1Y to have a potential from −600 V to −800 V prior to the operations.

The photoreceptor 1Y is formed by laminating a photosensitive layer on a conductive (volume resistivity at 20° C.: equal to or less than $1\times10^{-6}$ Ωcm, for example) base material. Although the photosensitive layer typically has high resistance (resistance of typical resin), the photosensitive layer has a characteristic that specific resistance at a portion irradiated with a laser beam changes in a case of being irradiated with the laser beam 3Y. Thus, the laser beam 3Y is output to the charged surface of the photoreceptor 1Y via the exposure device 3 in accordance with yellow image data sent from the control unit, which is not illustrated in the drawing. The photosensitive layer on the surface of the photoreceptor 1Y is irradiated with the laser beam 3Y, and an electrostatic charge image of a yellow image pattern is thus formed on the surface of the photoreceptor 1Y.

The electrostatic charge image is an image formed on the surface of the photoreceptor 1Y by the charging, and is a so-called negative latent image that is formed by lowering the specific resistance at the irradiated portion of the photosensitive layer with the laser beam 3Y and causing electric charge on the charged surface of the photoreceptor 1Y to flow while causing the electric charge at a portion that is not irradiated with the laser beam 3Y to remain.

The electrostatic charge image formed on the photoreceptor 1Y is rotated at a predetermined development position in response to traveling of the photoreceptor 1Y. Then, at the development position, the electrostatic charge image on the photoreceptor 1Y is visualized (developed) as a toner image by the developing device 4Y.

The developing device 4Y contains an electrostatic charge image developer that contains at least a yellow toner and a carrier, for example. The yellow toner is frictionally charged by being stirred in the developing device 4Y and is held on the developer roller (an example of the developer holding member) with electric charge with the same polarity (negative polarity) as that of the electric charge on the charged photoreceptor 1Y. Then, the yellow toner electrostatically adheres to a latent image portion, from which the charge is erased, on the surface of the photoreceptor 1Y by the surface of the photoreceptor 1Y passing through the developing device 4Y, and the latent image is developed by the yellow toner. The photoreceptor 1Y with the yellow toner image formed thereon is made to continuously travel at a predetermined speed, and the toner image developed on the photoreceptor 1Y is transported to a predetermined primary transfer position.

If the yellow toner image on the photoreceptor 1Y is transferred to the primary transfer, then the primary transfer bias is applied to the primary transfer roller 5Y, electrostatic force directed from the photoreceptor 1Y to the primary transfer roller 5Y acts on the toner image, and the toner image on the photoreceptor 1Y is transferred to the intermediate transfer belt 20. The transfer bias applied at this time has (+) polarity that is opposite to the polarity (−) of the toner, and the transfer bias in the first unit 10Y is controlled to +10 μA by the control unit (not shown), for example.

In contrast, the toner remaining on the photoreceptor 1Y is removed ad collected by the photoreceptor cleaning device 6Y.

The primary transfer biases to be applied to the primary transfer rollers 5M, 5C, and 5K of the second unit 10M and the following units are also controlled in the same manner as the first unit.

As described above, the intermediate transfer belt 20 to which the yellow toner image is transferred by the first unit 10Y is sequentially transported through the second to fourth units 10M, 10C, and 10K, toner images of the respective colors are transferred in an overlapped manner.

The intermediate transfer belt 20, to which the toner images of the four colors have been transferred in the overlapped manner through the first to fourth units, reaches a secondary transfer unit that includes the intermediate transfer belt 20, the support roller 24 in contact with the inner surface of the intermediate transfer belt, and a secondary transfer roller (an example of the secondary transfer unit) 26 arranged on the side of the image holding surface of the intermediate transfer belt 20. In contrast, a recording sheet (an example of the recording medium) P is supplied to a contact clearance between the secondary transfer roller 26 and the intermediate transfer belt 20 via a supply mechanism at predetermined timing, and a secondary transfer bias is applied to the support roller 24. The transfer bias applied at this time has (−) polarity that is the same as the polarity (−) of the toner, electrostatic force directed from the intermediate transfer belt 20 to the recording sheet P acts on the toner image, and the toner image on the intermediate transfer belt 20 is transferred to the recording sheet P. The secondary transfer bias applied at this time is determined in accordance with resistance detected by a resistance detecting unit (not shown) for detecting the resistance of the secondary transfer unit, and voltage controlled is performed thereon.

Thereafter, the recording sheet P is sent to a nip portion of a pair of fixing rollers in a fixing device (an example of the fixing unit) 28, the toner image is fixed on the recording sheet P, and a fixed image is formed.

Examples of the recording sheet P to which the transfer toner image is transferred include a plain paper used in a copying machine based on the electrophotography scheme, a printer, or the like. Examples of the recording medium other than the recording sheet P also include an OHP sheet.

In order to further enhancing smoothness of the surface of the image after the fixation, the recording sheet P also has a smooth surface, and for example, a coated paper obtained by coating a surface of a plain paper with resin or the like or an art paper for printing is preferably used.

The recording sheet P, on which the fixation of the color image is completed, is transported to a discharge unit, and the series of color image forming operations are completed.

Process Cartridge/Toner Cartridge

Description will be given of a process cartridge according to the exemplary embodiment.

The process cartridge according to the exemplary embodiment includes a developing unit that contains the electrostatic charge image developer according to the exemplary embodiment and develops, as a toner image, the electrostatic charge image formed on the surface of the image holding member by using the electrostatic charge image developer, and the process cartridge is detachable from the image forming apparatus.

The process cartridge according to the exemplary embodiment is not limited to the configuration, and may be configured to include the developing device, and if necessary, at least one selected from other units such as the image holding member, the charging unit, the electrostatic charge image forming unit, and the transfer unit.

Hereinafter, an example of the process cartridge according to the exemplary embodiment will be shown. However, the process cartridge is not limited thereto. In addition, main components illustrated in the drawing will be described, and description of the other components will be omitted.

Figure 2:
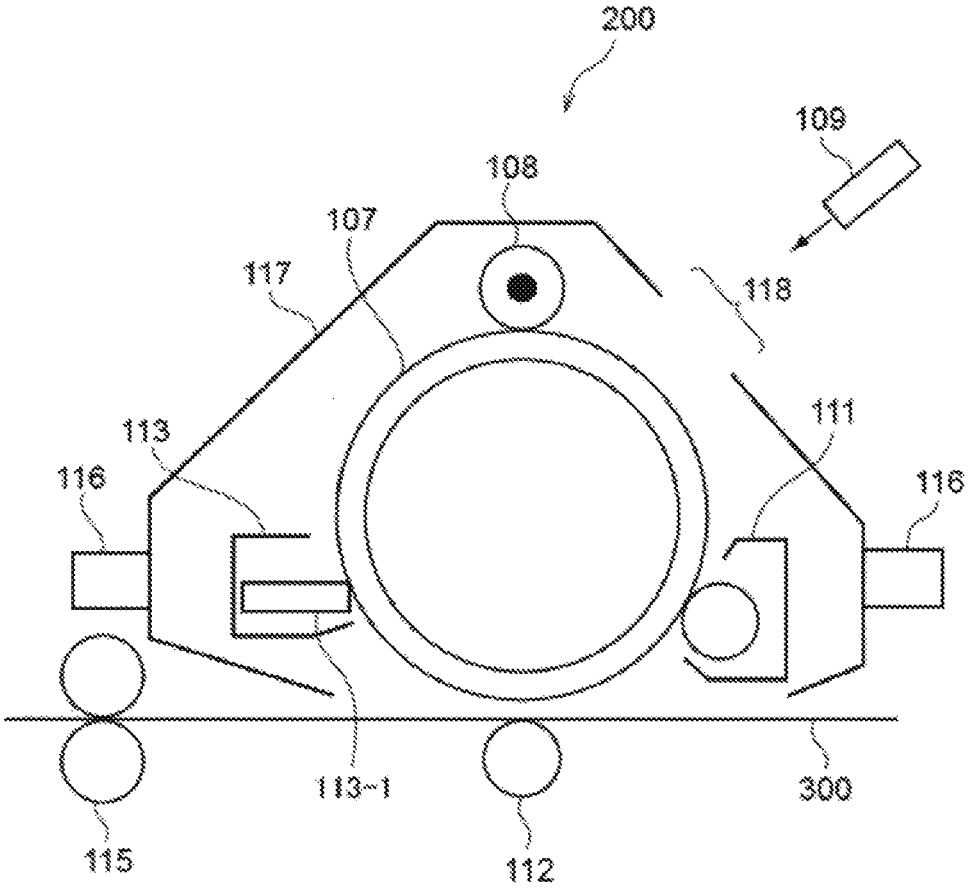
FIG. 2 is a configuration diagram schematically illustrating an example of a process cartridge according to the exemplary embodiment.

FIG. 2 is a configuration diagram schematically illustrating the process cartridge according to the exemplary embodiment.

A process cartridge 200 illustrated in FIG. 2 is configured such that a photoreceptor 107 (an example of the image holding member), a charging roller 108 (an example of the charging unit) provided in the periphery of the photoreceptor 107, a developing device 111 (an example of the developing unit), and a photoreceptor cleaning device 113 (an example of the cleaning unit) including a cleaning blade 113-1 are integrally combined and held in a housing 117 provided with an attachment rail 116 and an opening 118 for exposure, for example, and is formed as a cartridge.

In FIG. 2, 109 represents an exposure device (an example of the electrostatic charge image forming unit), 112 represents a transfer device (an example of the transfer unit), 115 represents a fixing device (an example of the fixing unit), and 300 represents a recording sheet (an example of the recording medium).

Next, description will be given of a toner cartridge according to the exemplary embodiment.

The toner cartridge according to the exemplary embodiment is a toner cartridge that contains the toner according to the exemplary embodiment and is detachable from the image forming apparatus. The toner cartridge is for containing the toner for replenishment to be supplied to the developing unit provided in the image forming apparatus.

The image forming apparatus illustrated in FIG. 1 is an image forming apparatus with a configuration to and from which the toner cartridges 8Y, 8M, 8C, and 8K are detachable, and the developing devices 4Y, 4M, 4C, and 4K are connected to the toner cartridges corresponding to the respective developing devices (colors) with toner supply tubes, which are not illustrated in the drawing. In a case in which the amount of the toner contained in a toner cartridge decreases, the toner cartridge is replaced.

EXAMPLES

Although more detailed description will be given below of the exemplary embodiment based on examples, the exemplary embodiment is not limited to these examples. In the following description, all the expressions "parts" and "%" represent "parts by weight" and "% by weight" unless otherwise particularly indicated.

Preparation of Toner Particles A to J

- Styrene (manufactured by Wako Pure Chemical Industries, Ltd.): 80 parts
- n-Butyl acrylate (manufactured by Wako Pure Chemical Industries, Ltd.): 20 parts
- Divinylbenzene (manufactured by Wako Pure Chemical Industries, Ltd.): 0.65 parts
- Dodecanethiol (manufactured by Wako Pure Chemical Industries, Ltd.): 2 parts
- Cyan pigment (Pigment Blue 15:3, manufactured by Dainichiseika Color & Chemicals): 8 parts The above materials are stirred and pre-mixed in a stainless steel container, are sufficiently dispersed by using a media-type disperser (paint shaker), and a polymerizable monomer composition is thus obtained.

The following components are put into a round-bottom flask made of stainless steel and are heated at 58° C.

- Ion-exchanged water: 80 parts
- 0.1 mol/L $Na_3PO_4$ aqueous solution: 100 parts
- 1N HCl aqueous solution: 2.8 parts Then, the mixture solution is dispersed and stirred under a condition of a rotation frequency of 13000 rpm by using a homogenizer (CLEARMIX manufactured by M Technique Co., Ltd.). 10 parts of 1.0 mol/L $CaCl_2$ aqueous solution is slowly added thereto, and an aqueous medium containing $Ca_3(PO_4)_2$ is thus prepared. The dispersed polymerizable monomer composition is poured into the $Ca_3(PO_4)_2$ dispersion while the temperature is maintained at 58° C., and the mixture is stirred until uniformized. 6 parts of tetramethylbutyl-peroxy-2-ethylhexanoate (manufactured by NOF Corporation, product name: PEROCTA O) is slowly added to the suspension while the suspension is dispersed by a homogenizer, and liquid droplets of the polymerizable monomer composition are formed.

A polymerization reaction is made to advance by raising the temperature of the above suspension, in which the liquid droplets are dispersed, to 90° by externally heating the suspension while stirring the suspension in a reactor capable of refluxing. The suspension is cooled to the room temperature after sufficiently causing the reaction while maintaining the temperature, a suspension of colored resin particles is obtained, diluted hydrochloric acid is dropped at the room temperature, $Ca_3(PO_4)_2$ is dissolved and removed, and washing with acid is performed. The extracted suspension is sufficiently washed with ion-exchanged water and is subjected to solid-liquid separation by Nutsche suction filtration. Then, the resulting substance is dispersed again in ion-exchanged water at 40° C. and washed while stirred for 15 minutes. The washing operation is repeated several times, the resulting substance is subjected to solid-liquid separation by Nutsche suction filtration and is freeze-dried in vacuum, and toner particles A are thus obtained. At this time, the volume average particular diameter is 6.1 μm, the average circularity is 0.989, and the number-particle diameter distribution index (lower GSD) on the small diameter side is 1.23.

Toner particles B with a volume average particle diameter of 6.3 μm, average circularity of 0.981, and a number-particle diameter distribution index (lower GSD) on a small diameter side of 1.27 are similarly prepared by using the above preparation method.

Toner particles C with a volume average particle diameter of 6.4 μm, average circularity of 0.996, and a number-particle diameter distribution index (lower GSD) on a small diameter side of 1.25 are similarly prepared by using the above preparation method.

Toner particles D with a volume average particle diameter of 6.2 μm, average circularity of 0.977, and a number-particle diameter distribution index (lower GSD) on a small diameter side of 1.24 are similarly prepared by using the above preparation method.

Toner particles I with a volume average particle diameter of 6.5 μm, average circularity of 0.980, and a number-particle diameter distribution index (lower GSD) on a small diameter side of 1.48 are similarly prepared by using the above preparation method.

Toner particles J with a volume average particle diameter of 6.6 μm, average circularity of 0.981, and a number-particle diameter distribution index (lower GSD) on a small diameter side of 1.53 are similarly prepared by using the above preparation method.

Toner particles H with a volume average particle diameter of 6.7 μm, average circularity of 0.983, and a number-particle diameter distribution index (lower GSD) on a small diameter side of 1.51 are similarly prepared by using the above preparation method.

Toner particles E with a volume average particle diameter of 6.2 μm, average circularity of 0.982, and a number-particle diameter distribution index (lower GSD) on a small diameter side of 1.35 are prepared by classifying the toner H.

Toner particles F with a volume average particle diameter of 6.3 μm, average circularity of 0.984, and a number-particle diameter distribution index (lower GSD) on a small diameter side of 1.41 are prepared by classifying the toner H.

Toner particles G with a volume average particle diameter of 6.5 μm, average circularity of 0.983, and a number-particle diameter distribution index (lower GSD) on a small diameter side of 1.48 are prepared by classifying the toner H.

Preparation of Toner Particles K

Preparation of Unmodified Polyester Resin

Ethylene oxide adduct of bisphenol A: 170 parts
Propylene oxide adduct of bisphenol A: 20 parts
Terephthalic acid: 220 parts The above monomers are put into a three-necked flask completely dried and substituted with $N_2$, the monomer is heated at 185° C. and is melted while $N_2$ is fed, and the monomer is then sufficiently mixed. After adding 0.1 parts of dibutyl tin oxide thereto, the temperature in the system is increased to 210° C., and the reaction is made to advance while the temperature is maintained. The progress of the reaction is controlled by adjusting the temperature and collecting humidity in a reduced-pressure atmosphere while measuring the molecular weight of a small amount of collected sample in the process, and a desired condensate is thus obtained.

Preparation of Polyester Prepolymer

Ethylene oxide adduct of bisphenol A: 187 parts
Propylene oxide adduct of bisphenol A-: 26 parts
Terephthalic acid: 7 parts
Isophthalic acid: 85 parts The above monomers are put into a three-necked flask completely dried and substituted with $N_2$, the monomer is heated at 185° C. and is melted while $N_2$ is fed, and the monomer is then sufficiently mixed. After adding 0.4 parts of dibutyl tin oxide thereto, the temperature in the system is increased to 210° C., and the reaction is made to advance while the temperature is maintained. The progress of the reaction is controlled by adjusting the temperature and collecting humidity in a reduced-pressure atmosphere while measuring the molecular weight of a small amount of collected sample in the process, and a desired condensate is thus obtained. Next, the temperature is lowered to 175° C., 8 parts of phthalic anhydride is then added thereto, and the mixture is stirred for 3 hours in a reduced-pressure atmosphere to cause the reaction. 340 parts of the thus obtained condensate, 27 parts of isophorone diisocyanate, and 420 parts of ethyl acetate are put into another three-necked flask completely dried and substituted with N2, the mixture is heated at 72° C. for 6 hours while N2 is fed thereto, and polyester prepolymer having isocyanate groups (hereinafter, "isocyanate-modified polyester prepolymer) is obtained.

Preparation of Ketimine Compound

Methyl ethyl ketone: 25 parts
Isophorone diamine: 20 parts

The above materials are put into a container and are stirred while heated at 60° C., and a ketimine compound is thus obtained.

Preparation of Pigment Dispersion

Cyan pigment (C.I.Pigment Blue 15:3 manufactured by Dainichiseika Color & Chemicals Mfg. Co., Ltd.): 18 parts
Ethyl acetate: 70 parts
SOLSPERSE 5000 (manufactured by Zeneca Inc.): 1.2 parts The above components are mixed and dissolved/dispersed by using a sand mill, and a pigment dispersion is thus obtained.

Preparation of Release Agent Dispersion

Paraffin wax (melting temperature: 89° C.): 25 parts
Ethyl acetate: 240 parts

The above components are wet-pulverized by a micro bead-type disperser (DCP mil) in a state of being cooled at 15° C., and a release agent dispersion is thus obtained.

Preparation of Oil Phase Solution

Pigment dispersion: 35 parts
Bentonite (manufactured by Wako Pure Chemical Industries, Ltd.): 8 parts
Ethyl acetate: 60 parts The above components are put and sufficiently stirred and mixed. 140 parts of unmodified polyester resin and 80 parts of release agent dispersion are added to the obtained mixture solution, the mixture is sufficiently stirred, and an oil phase solution is prepared.

Preparation of Styrene Acrylic Resin Particle Dispersion (2)

Styrene: 80 parts
n-Butyl acrylate: 120 parts
Methacrylic acid: 80 parts
Polyoxyalkylene methacrylate sulfate ester Na (ELEMINOL RS-30 manufactured by Sanyo Chemical Industries Co., Ltd.): 8 parts
Dodecanethiol: 4 parts The above components are put into a reactor capable of refluxing and are sufficiently stirred and mixed. 700 parts of ion-exchanged water and 1.2 parts of ammonium persulfate are quickly put into the mixture and are dispersed and emulsified by a homogenizer (ULTRATURRAX T50 manufactured by IKA) while the temperature is maintained to be equal to or less than the room temperature, and a white emulsified solution is thus obtained. The temperature in the system is increased to 70° C. while $N_2$ is fed and the mixture is stirred, and emulsification polymerization is continued as it is for 6 hours. Furthermore, 18 parts of 1% aqueous solution of ammonium persulfate is slowly dropped thereto, the temperature is then maintained at 70° C. for 2 hours, and the polymerization is completed.

Preparation of Water Phase Solution

Styrene acrylic resin particle dispersion (2): 55 parts

2% aqueous solution of CELOGEN BS-H (CMC, DKS Co., Ltd.): 180 parts

Anionic surfactant (DOWFAX 2A1 manufactured by Dow Chemical Company): 3 parts

Ion-exchanged water: 220 parts

The above components are sufficiently stirred and mixed, and a water phase solution is thus prepared.

Preparation of Toner Particles K

Oil phase solution: 380 parts

Isocyanate-modified polyester prepolymer: 28 parts

Ketimine compound: 1.5 parts

The above components are put into a round-bottom flask made of stainless steel and are stirred by a homogenizer (ULTRATURRAX manufactured by IKA) for 2 minutes, a mixed oil phase solution is thus prepared, 900 parts of water phase solution is then added to the flask, and the mixture is quickly and forcibly emulsified by a homogenizer (8,000 rpm) for about 1 minute. Then, the emulsion is stirred at a temperature of equal to or less than the ordinary temperature under an ordinary pressure (1 atm) for about 15 minutes by using a paddle-type stirrer, and formation of particles and a urea modification reaction of polyester resin are made to advance. Thereafter, the mixture is stirred at 75° C. for 8 hours while the solvent is evaporated at a reduced pressure or is removed at the ordinary pressure, and the urea modification reaction is completed.

After cooling the resultant to the ordinary temperature, the suspension of the prepared particles is extracted, sufficiently washed with ion-exchanged water, and is subjected to solid-liquid separation by Nutsche suction filtration. Next, the suspension is dispersed again in ion-exchanged water at 35° C. and is washed for 15 minutes while stirred. The washing operation is repeated several times, the sold liquid separation by the Nutsche suction filtration is performed, the suspension is freeze-dried in vacuum, and toner particles K are thus obtained.

At this time, the volume average particle diameter is 6.5 μm, the average circularity is 0.985, and the number-particle diameter distribution index (lower GSD) on the small diameter side is 1.30.

Preparation of External Additive

Preparation of Silica Particle Dispersion (1)

300 parts of methanol and 70 parts of 10% ammonia aqueous solution are added to and mixed in a 1.5 L reactor made of glass and provided with a stirrer, a dropping nozzle, and a thermometer, and an alkali catalytic solution is thus obtained.

After the temperature of the alkali catalytic solution is adjusted to 30° C., 185 parts of tetramethoxysilane and 50 parts of 8.0% ammonia aqueous solution are dropped at the same time while stirring is performed, and a hydrophilic silica particle dispersion (solid content concentration: 12.0% by weight) is thus obtained. Here, the dropping time is set to 30 minutes.

Thereafter, the obtained silica particle dispersion is concentrated to solid content concentration of 40% by weight by a rotary filter R-FINE (manufactured by Kotobuki Industries Co., Ltd.). The concentrated substance is obtained as a silica particle dispersion (1).

Preparation of Silica Particle Dispersions (2) to (8)

Silica particle dispersions (2) to (8) are prepared in the same manner as the silica particle dispersion (1) other than that the alkali catalytic solution (the amount of methanol and the amount of 10% ammonia aqueous solution) and the silica particle formation conditions (the total amount of tetramethoxysilane (described as TMOS) and 8% ammonia aqueous solution dropped to the alkali catalytic solution and dropping time thereof) are changed in accordance with Table 1 in the preparation of the silica particle dispersion (1).

Details of the silica particle dispersions (1) to (8) will be shown below in Table 1.

| Silica | Alkali catalytic solution | | Silica particle formation conditions | | |
|---|---|---|---|---|---|
| particle dispersion | Methanol (part) | 10% ammonium water (part) | Total dropping amount of TMOS (part) | Total dropping amount of 8% ammonium water (part) | Dropping time |
| (1) | 300 | 70 | 185 | 50 | 30 minutes |
| (2) | 300 | 70 | 340 | 92 | 55 minutes |
| (3) | 300 | 46 | 40 | 25 | 30 minutes |
| (4) | 300 | 70 | 62 | 17 | 10 minutes |
| (5) | 300 | 70 | 700 | 200 | 120 minutes |
| (6) | 300 | 70 | 500 | 140 | 85 minutes |
| (7) | 300 | 70 | 1000 | 280 | 170 minutes |
| (8) | 300 | 70 | 3000 | 800 | 520 minutes |

Preparation of Surface Treated Silica Particles (S1)

The silica particle dispersion (1) is used to treat the surfaces of the silica particles with the siloxane compound in an atmosphere of supercritical carbon dioxide as follows. In the surface treatment, an apparatus that includes a carbon dioxide cylinder, a carbon dioxide pump, an entrainer pump, an autoclave provided with a stirrer (content of 500 ml), and a pressure valve is used.

First, 250 parts of the silica particle dispersion (1) is put into the autoclave with a stirrer (content of 500 ml), and the stirrer is rotated at 100 rpm. Thereafter, liquefied carbon dioxide is poured into the autoclave, the pressure is boosted by the carbon dioxide pump while the temperature is raised by a heater, and a supercritical state at 150° C. and 15 MPa is obtained in the autoclave. Supercritical carbon dioxide is distributed by the carbon dioxide pump while the pressure in the autoclave is maintained at 15 MPa by the pressure valve, methanol and water are removed from the silica particle dispersion (1) (solvent removing process), and silica particles (untreated silica particles) are thus obtained.

Next, the distribution of supercritical carbon dioxide is stopped at the timing when the amount of supercritical carbon dioxide distributed (the cumulative amount: measured as the amount of carbon dioxide distributed in a standard state) reaches 900 parts.

Thereafter, a processing agent solution, which is obtained by dissolving 0.3 parts of dimethyl silicone oil (DSO: product name "KF-96 (manufactured by Shin-Etsu Chemical Co., Ltd.)") with viscosity of 10,000 cSt as a siloxane compound in 20 parts of hexamethyldisilazane (HMDS: manufactured by Yuki Gosei Kogyo Co., Ltd.) in advance as a hydrophobizing agent with respect to 100 parts of the silica particles (untreated silica particles), is poured into the autoclave by the entrainer pump in a state where the supercritical state of carbon dioxide is maintained in the autoclave by maintain the temperature at 150° C. by the heater and maintaining the pressure at 15 MPa by the carbon dioxide pump, and a reaction is then caused at 180° C. for 20 minutes while the processing agent solution is stirred. Thereafter, supercritical carbon dioxide is distributed again, and excessive processing agent solution is removed. Thereafter, the stirring is stopped, the pressure in the autoclave is opened to the atmospheric pressure by opening the pressure valve, and the temperature is lowered to the room temperature (25° C.).

The solvent removing process and the surface treatment with the siloxane compound are performed in order as described above, and surface treated silica particles (S1) are thus obtained.

Preparation of Surface Treated Silica Particles (S2) to (S5), (S7) to (S9), and (S12) to (S17)

The surface treated silica particles (S2) to (S5), (S7) to (S9), and (S12) to (S17) are prepared in the same manner as the surface treated silica particles (S1) other than that the silica particle dispersion, the surface treatment conditions (the treatment atmosphere, the siloxane compound (type, viscosity, and the additive amount thereof), the hydrophobizing agent, and the additive amount thereof) are changed in accordance with Table 2 in the preparation of the surface treated silica particles (S1).

Preparation of Surface Treated Silica Particles (S6)

The same dispersion as the silica particle dispersion (1) used in the preparation of the surface treated silica particles (S1) is used to treat the surfaces of the silica particles with the siloxane compound in the atmospheric air atmosphere as follows.

An ester adaptor and a cooling tube are attached to the reactor used in the preparation of the silica particle dispersion (1), the silica particle dispersion (1) is heated at 60° C. to 70° C., methanol is evaporated, water is then added, the silica particle dispersion (1) is further heated at 70° C. to 90° C. to evaporate methanol, and water dispersion of the silica particles is thus obtained. 3 parts of methyltrimethoxysilane (MTMS: manufactured by Shin-Etsu Chemical Co., Ltd.) is added to 100 parts of the silica particles in the water dispersion at the room temperature, a reaction is caused for 2 hours, and the surfaces of the silica particles are treated. After adding methyl isobutyl ketone to the surface treated dispersion, the mixture is heated at 80° C. to 110° C. to evaporate methanol solution, 80 parts of hexamethyldisilazane (HMDS: manufactured by Yuki Gosei Kogyo Co., Ltd.) and 1.0 parts of dimethyl silicone oil (DSO: product name "KF-96 (manufactured by Shin-Etsu Chemical Co., Ltd.)") with viscosity of 10,000 cSt as a siloxane compound are added to 100 arts of silica particles in the obtained dispersion, a reaction is caused at 120° C. for 3 hours, the mixture is cooled and then dried by spray drying, and surface treated silica particles (S6) are thus obtained.

Preparation of Surface Treated Silica Particles (S10)

Surface treated silica particles (S10) are prepared in the same manner as the surface treated silica particles (S1) other than that FUMED SILICA OX50 (AEROSIL OX50 manufactured by Nippon Aerosil Co., Ltd.) is used instead of the silica particle dispersion (1). That is, 100 parts of OX50 is put into the same autoclave provided with the stirrer as that used in the preparation of the surface treated silica particles (S1), and the stirrer is rotated at 100 rpm. Thereafter, liquefied carbon dioxide is poured into the autoclave, the pressure is boosted by the carbon dioxide pump while the temperature is raised by the heater, and the supercritical state at 180° C. at 15 MPa is obtained in the autoclave. A processing agent solution, which is obtained by dissolving 0.3 parts of dimethyl silicone oil (DSO: product name "KF-96 (manufactured by Shin-Etsu Chemical Co., Ltd.)") with viscosity of 10,000 cSt as a siloxane compound in 20 parts of hexamethyldisilazane (HMDS: manufactured by Yuki Gosei Kogyo Co., Ltd.) in advance as a hydrophobizing agent, is poured into the autoclave by the entrainer pump while the pressure in the autoclave is maintained at 15 MPa by the pressure valve, a reaction is then caused at 180° C. for 20 minutes while the processing agent solution is stirred, supercritical carbon dioxide is then distributed, the excessive processing agent solution is removed, and surface treated silica particles (S10) are thus obtained.

Preparation of Surface Treated Silica Particles (S11)

Surface treated silica particles (S11) are prepared in the same manner as the surface treated silica particles (S1) other than that FUMED SILICA A50 (AEROSIL A50 manufactured by Nippon Aerosil Co., Ltd.) is used instead of the silica particle dispersion (1). That is, 100 parts of A50 is put into the same autoclave provided with the stirrer as that used in the preparation of the surface treated silica particles (S1), and the stirrer is rotated at 100 rpm. Thereafter, liquefied carbon dioxide is poured into the autoclave, the pressure is boosted by the carbon dioxide pump while the temperature is raised by the heater, and the supercritical state at 180° C. at 15 MPa is obtained in the autoclave. A processing agent solution, which is obtained by dissolving 1.0 parts of dimethyl silicone oil (DSO: product name "KF-96 (manufactured by Shin-Etsu Chemical Co., Ltd.)") with viscosity of 10,000 cSt as a siloxane compound in 40 parts of hexamethyldisilazane (HMDS: manufactured by Yuki Gosei Kogyo Co., Ltd.) in advance as a hydrophobizing agent, is poured into the autoclave by the entrainer pump while the pressure in the autoclave is maintained at 15 MPa by the pressure valve, a reaction is then caused at 180° C. for 20 minutes while the processing agent solution is stirred, super critical carbon dioxide is then distributed, the excessive processing agent solution is removed, and surface treated silica particles (S11) are thus obtained.

Preparation of Surface Treated Silica Particles (SC1)

Surface treated silica particles (SC1) are prepared in the same manner as the surface treated silica particles (S1) other than that the siloxane compound is not added in the preparation of the surface treated silica particles (S1).

Preparation of Surface Treated Silica Particles (SC2) to (SC4)

Surface treated silica particles (SC2) to (SC4) are prepared in the same manner as the surface treated silica particles (S1) other than that the silica particle dispersion, the surface treatment conditions (the treatment atmosphere, the siloxane compound (type, viscosity, and additive amount thereof), the hydrophobizing agent, and the additive amount thereof) are changed in accordance with Table 3 in the preparation of the surface treated silica particles (S1).

Preparation of Surface Treated Silica Particles (SC5)

Surface treated silica particles (SC5) are prepared in the same manner as the surface treated silica particles (S6) other than that the siloxane compound is not added in the preparation of the surface treated silica particles (S6).

Preparation of Surface Treated Silica Particles (SC6)

Surface treated silica particles (SC6) are prepared by filtering the silica particle dispersion (8), drying the resulting substance at 120° C., putting the resulting substance into an electric furnace, burning the resulting substance at 400° C. for 6 hours, then spraying 10 parts of HMDS with respect to 100 parts of silica particles and drying the resulting substance in the form of spray dry.

Physical Properties of Surface Treated Silica Particles

Average equivalent circle diameters, average circularity, adhesion amounts of the siloxane compounds to the untreated silica particles (described as "surface attachment amount" in the table), compression aggregation degrees, particle compression ratios, and particle dispersion degrees of the obtained surface treated silica particles are measured by the above methods.

Details of the surface treated silica particles will be listed in Tables 2 and 3 shown below. The abbreviations in Tables 2 and 3 are as follows.

DSO: dimethyl silicone oil

HMDS: hexamethyldisilazane

TABLE 2

| | | Surface treatment conditions | | | | | Properties of surface-treated silica particles | | | | | |
|---|---|---|---|---|---|---|---|---|---|---|---|---|
| | | Siloxane compound | | | | | | | | | | |
| Surface-treated silica particles | Silica particle dispersion | Type | Viscosity (cSt) | Additive amount (part) | Treatment atmosphere | Hydrophobizing agent/part | Average equivalent circle diameter (nm) | Average circularity | Surface attachment amount (% by weight) | Compression aggregation degree (%) | Particle compression ratio | Particle dispersion degree (%) |
| (S1) | (1) | DSO | 10000 | 0.3 parts | Supercritical $CO_2$ | HMDS/ 20 parts | 120 | 0.958 | 0.28 | 85 | 0.310 | 98 |
| (S2) | (1) | DSO | 10000 | 1.0 parts | Supercritical $CO_2$ | HMDS/ 20 parts | 120 | 0.958 | 0.98 | 92 | 0.280 | 97 |
| (S3) | (1) | DSO | 5000 | 0.15 parts | Supercritical $CO_2$ | HMDS/ 20 parts | 120 | 0.958 | 0.12 | 80 | 0.320 | 99 |
| (S4) | (1) | DSO | 5000 | 0.5 parts | Supercritical $CO_2$ | HMDS/ 20 parts | 120 | 0.958 | 0.47 | 88 | 0.295 | 98 |
| (S5) | (2) | DSO | 10000 | 0.2 parts | Supercritical $CO_2$ | HMDS/ 20 parts | 140 | 0.962 | 0.19 | 81 | 0.360 | 99 |
| (S6) | (1) | DSO | 10000 | 1.0 parts | Atmospheric air | HMDS/ 80 parts | 120 | 0.958 | 0.50 | 83 | 0.380 | 93 |
| (S7) | (3) | DSO | 10000 | 0.3 parts | Supercritical $CO_2$ | HMDS/ 20 parts | 130 | 0.850 | 0.29 | 68 | 0.350 | 92 |
| (S8) | (4) | DSO | 10000 | 0.3 parts | Supercritical $CO_2$ | HMDS/ 20 parts | 90 | 0.935 | 0.29 | 94 | 0.390 | 95 |
| (S9) | (1) | DSO | 50000 | 1.5 parts | Supercritical $CO_2$ | HMDS/ 20 parts | 120 | 0.958 | 1.25 | 95 | 0.240 | 91 |
| (S10) | FUMED SILICA OX50 | DSO | 10000 | 0.3 parts | Supercritical $CO_2$ | HMDS/ 20 parts | 80 | 0.680 | 0.26 | 84 | 0.395 | 92 |
| (S11) | FUMED SILICA A50 | DSO | 10000 | 1.0 parts | Supercritical $CO_2$ | HMDS/ 40 parts | 45 | 0.880 | 0.91 | 88 | 0.276 | 91 |
| (S12) | (3) | DSO | 5000 | 0.04 parts | Supercritical $CO_2$ | HMDS/ 20 parts | 130 | 0.850 | 0.02 | 62 | 0.360 | 96 |
| (S13) | (3) | DSO | 1000 | 0.5 parts | Supercritical $CO_2$ | HMDS/ 20 parts | 130 | 0.850 | 0.46 | 90 | 0.380 | 92 |
| (S14) | (3) | DSO | 10000 | 5.0 parts | Supercritical $CO_2$ | HMDS/ 20 parts | 130 | 0.850 | 4.70 | 95 | 0.360 | 91 |
| (S15) | (5) | DSO | 10000 | 0.5 parts | Supercritical $CO_2$ | HMDS/ 20 parts | 185 | 0.971 | 0.43 | 61 | 0.209 | 96 |
| (S16) | (6) | DSO | 10000 | 0.5 parts | Supercritical $CO_2$ | HMDS/ 20 parts | 164 | 0.97 | 0.41 | 64 | 0.224 | 97 |
| (S17) | (7) | DSO | 10000 | 0.5 parts | Supercritical $CO_2$ | HMDS/ 20 parts | 210 | 0.978 | 0.44 | 60 | 0.205 | 98 |

TABLE 3

| | | Surface treatment conditions | | | | | Properties of surface-treated silica particles | | | | | |
|---|---|---|---|---|---|---|---|---|---|---|---|---|
| | | Siloxane compound | | | | | | | | | | |
| Surface-treated silica particles | Silica particle dispersion | Type | Viscosity (cSt) | Additive amount (part) | Treatment atmosphere | Hydrophobizing agent/part | Average equivalent circle diameter (nm) | Average circularity | Surface attachment amount (% by weight) | Compression aggregation degree (%) | Particle compression ratio | Particle dispersion degree (%) |
| (SC1) | (1) | — | — | — | Supercritical $CO_2$ | HMDS/ 20 parts | 120 | 0.958 | — | 55 | 0.415 | 99 |
| (SC2) | (1) | DSO | 100 | 3.0 parts | Supercritical $CO_2$ | HMDS/ 20 parts | 120 | 0.958 | 0.25 | 98 | 0.450 | 75 |

TABLE 3-continued

| Surface-treated silica particles | Silica particle dispersion | Surface treatment conditions: Siloxane compound: Type | Viscosity (cSt) | Additive amount (part) | Treatment atmosphere | Hydrophobizing agent/part | Properties of surface-treated silica particles: Average equivalent circle diameter (nm) | Average circularity | Surface attachment amount (% by weight) | Compression aggregation degree (%) | Particle compression ratio | Particle dispersion degree (%) |
|---|---|---|---|---|---|---|---|---|---|---|---|---|
| (SC3) | (1) | DSO | 1000 | 8.0 parts | Supercritical $CO_2$ | HMDS/ 20 parts | 120 | 0.958 | 7.0 | 99 | 0.360 | 83 |
| (SC4) | (3) | DSO | 3000 | 10.0 parts | Supercritical $CO_2$ | HMDS/ 20 parts | 130 | 0.850 | 8.5 | 99 | 0.380 | 85 |
| (SC5) | (1) | — | — | — | Atmospheric air | HMDS/ 80 parts | 120 | 0.958 | — | 62 | 0.425 | 98 |
| (SC6) | (8) | — | — | — | Atmospheric air | HMDS/ 10 parts | 300 | 0.980 | — | 60 | 0.197 | 93 |

Examples 1 to 25 and Comparative Examples 1 to 8

The silica particles shown in Tables 4 and 5 are added to 100 parts of the toner particles shown in Tables 4 and 5 at amounts shown in Tables 4 and 5, the particles are mixed at 2,000 rpm for 3 minutes by a HENSCHEL mixer, and toners in the respective examples are obtained.

Then, each obtained toner and a carrier are put into a V BLENDER at a rate of toner:carrier=5:95 (weight ratio), the toner and the carrier are stirred for 20 minutes, and each developer is thus obtained.

The carrier prepared as follows is used.

Ferrite particles (volume average particle diameter: 50 μm): 100 parts

Toluene: 14 parts

Styrene-methyl methacrylate copolymer: 2 parts (component ratio: 90/10, Mw=80,000)

Carbon black (R330: manufactured by Cabot Corporation): 0.2 parts

First, the above components except for the ferrite particles are stirred by a stirrer for 10 minutes, a dispersed coating solution is prepared, the coating solution and the ferrite particles are then put into a vacuum deaeration-type kneader and are stirred at 60° C. for 30 minutes. Then, a carrier is thus obtained by performing depressurization, deaeration, and drying while further warming the covering solution and the ferrite particles.

Evaluation

For the developers obtained in the respective examples, charge holding properties of the toner and defect in image quality due to crack on the photoreceptor are evaluated. The results will be shown in Tables 4 and 5.

Charge Holding Property of Toner

In the evaluation of defect in image quality due to crack on the photoreceptor described below, the initial charge amount of the toner before image formation, the charge amounts of the toner after elapse of time after the printing (the charge amounts after printing 10 thousand images, after printing 20 thousand images, and after printing 30 thousand images) by a blow-off charge amount measurement apparatus (TB-200 manufactured by Toshiba Chemical Corporation).

The charge holding properties are evaluated by evaluation criteria based on the following equation.

Equation: charge holding property (%)=(1−(charge amount of toner after elapse of time/initial charge amount of toner))×100

The evaluation criteria are as follows.

A: equal to or less than 5%

B: greater than 5% and equal to or less than 10%

C: greater than 10% and equal to or less than 15%

D: greater than 15%

Defect in Image Quality Due to Crack on Photoreceptor

A developing device in an image forming apparatus (DOCUCENTRE-III C7600 manufactured by Fuji Xerox Co., Ltd.) is filled with the developer obtained in each example. 30 thousand images with an image density of 1.8 and an image area of 5% are printed on A4 sheets by the image forming apparatus in an environment at a temperature of 20° C. and a humidity of 20 RH. In this process, the surface of the photoreceptor is observed after printing 10 thousand images, 20 thousand images, and 30 thousand images, and defect in image quality is evaluated by the following evaluation criteria.

A: No crack is observed on the photoreceptor, and no defect in image quality is observed.

B: Slight crack is observed on the photoreceptor, and no defect in image quality is observed.

C: Slight crack is observed on the photoreceptor, and slight defect in image quality is observed.

D: Crack is observed on the photoreceptor, and defect in image quality such as streak is observed.

TABLE 4

| | Developer: Toner particles | Surface-treated silica particles: Type | Part | Charge holding property of toner: Initial stage (μC/g) | After printing 10 thousand images | After printing 20 thousand images | After printing 30 thousand images | Image quality: After printing 10 thousand images | After printing 20 thousand images | After printing 30 thousand images |
|---|---|---|---|---|---|---|---|---|---|---|
| Example 1 | A | (S1) | 2.0 | −64.5 | A | A | A | A | A | A |
| Example 2 | A | (S2) | 2.0 | −66.2 | A | A | A | A | A | A |
| Example 3 | A | (S3) | 2.0 | −60.5 | A | A | A | A | A | A |

TABLE 4-continued

| | Developer | | | Charge holding property of toner | | | | Image quality | | |
|---|---|---|---|---|---|---|---|---|---|---|
| | Toner | Surface-treated silica particles | | Initial stage | After printing 10 thousand | After printing 20 thousand | After printing 30 thousand | After printing 10 thousand | After printing 20 thousand | After printing 30 thousand |
| | particles | Type | Part | (μC/g) | images | images | images | images | images | images |
| Example 4 | A | (S4) | 2.2 | −65.4 | A | A | A | A | A | A |
| Example 5 | A | (S5) | 2.5 | −57.7 | A | A | A | A | A | A |
| Example 6 | A | (S6) | 1.8 | −61.9 | A | B | B | A | B | B |
| Example 7 | A | (S7) | 2.0 | −58.1 | A | B | B | A | B | B |
| Example 8 | A | (S8) | 1.6 | −67.0 | A | B | C | A | B | C |
| Example 9 | A | (S9) | 3.0 | −66.0 | A | B | B | A | B | B |
| Example 10 | A | (S10) | 3.3 | −68.2 | A | B | C | A | B | C |
| Example 11 | A | (S11) | 4.1 | −68.0 | A | B | C | A | B | C |
| Example 12 | A | (S12) | 2.0 | −66.4 | A | B | C | A | B | C |
| Example 13 | A | (S13) | 2.0 | −65.9 | A | A | B | A | A | B |
| Example 14 | A | (S14) | 2.0 | −64.8 | A | A | B | A | A | B |
| Example 15 | A | (S15) | 2.0 | −58.9 | B | C | C | B | C | C |
| Example 16 | A | (S16) | 2.0 | −60.1 | B | C | C | B | C | C |
| Example 17 | A | (S17) | 2.0 | −56.0 | C | C | C | C | C | C |
| Example 18 | B | (S1) | 2.0 | −63.7 | A | A | A | A | A | A |
| Example 19 | C | (S1) | 2.0 | −60.3 | A | A | A | A | A | A |
| Example 20 | E | (S1) | 2.0 | −63.0 | A | A | A | A | A | A |

TABLE 5

| | Developer | | | Charge holding property of toner | | | | Image quality | | |
|---|---|---|---|---|---|---|---|---|---|---|
| | Toner | Surface-treated silica particles | | Initial stage | After printing 10 thousand | After printing 20 thousand | After printing 30 thousand | After printing 10 thousand | After printing 20 thousand | After printing 30 thousand |
| | particles | Type | part | (μC/g) | images | images | images | images | images | images |
| Example 21 | F | (S1) | 2.0 | −63.2 | A | B | B | A | B | B |
| Example 22 | G | (S1) | 2.0 | −62.8 | A | B | B | A | B | B |
| Example 23 | H | (S1) | 1.8 | −58.8 | A | B | C | A | B | C |
| Example 24 | I | (S1) | 2.0 | −59.4 | A | B | C | A | B | C |
| Example 25 | J | (S1) | 2.0 | −57.8 | A | B | C | A | B | C |
| Comparative Example 1 | A | (SC1) | 2.0 | −66.2 | B | C | C | D | D | D |
| Comparative Example 2 | A | (SC2) | 1.8 | −64.1 | B | D | D | C | D | D |
| Comparative Example 3 | A | (SC3) | 1.2 | −63.7 | B | C | D | C | D | D |
| Comparative Example 4 | A | (SC4) | 3.5 | −60.5 | B | C | D | C | C | D |
| Comparative Example 5 | A | (SC5) | 5.2 | −65.1 | D | D | D | D | D | D |
| Comparative Example 6 | A | (SC6) | 1.8 | −50.8 | D | D | D | D | D | D |
| Comparative Example 7 | D | (S1) | 2.0 | −66.9 | B | C | D | B | C | D |
| Comparative Example 8 | K | (S1) | 2.0 | −61.2 | C | C | D | C | C | D |

It is possible to recognize from the above results that high charge holding properties of the toners are achieved and crack on the photoreceptor is prevented in the examples as compared with the comparative examples.

It is possible to recognize that high charge holding properties of the toners are achieved and crack on the photoreceptor is prevented especially in Examples 1 to 5, in which the silica particles with the compression aggregation degrees from 80% to 92% and particle compression ratios from 0.24 to 0.37 are applied as external additives, as compared with the other examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holding member;

a charging unit that charges a surface of the image holding member;

an electrostatic charge image forming unit that forms an electrostatic charge image on a charged surface of the image holding member;

a developing unit that contains an electrostatic charge image developer and develops the electrostatic charge image formed on the surface of the image holding member as a toner image by using the electrostatic charge image developer;

a transfer unit that transfers the toner image formed on the surface of the image holding member to a surface of a recording medium;

a cleaning unit that includes a cleaning blade for cleaning the surface of the image holding member; and a fixing unit that fixes the toner image transferred to the surface of the recording medium, wherein the electrostatic charge image developer contains a carrier and an electrostatic charge image developing toner that includes a toner particle and an external additive;

the toner particles have an average circularity of from 0.98 to 1.00 and a number-particle diameter distribution index (lower GSD) on a small diameter side of 1.22 or more and contain at least a vinyl resin; and the external additive that contains silica particles having a compression aggregation degree of 60% to 95% and a particle compression ratio of 0.20 to 0.40.

2. The image forming apparatus according to claim 1, wherein an average equivalent circle diameter of the silica particles is from 40 nm to 200 nm.

3. The image forming apparatus according to claim 1, wherein a particle dispersion degree of the silica particles is from 90% to 100%.

4. The image forming apparatus according to claim 1, wherein the silica particles are silica particles that are surface-treated with a siloxane compound having a viscosity of 1,000 cSt to 50,000 cSt and a surface attachment amount of the siloxane compound is from 0.01% by weight to 5% by weight.

5. The image forming apparatus according to claim 4, wherein the siloxane compound is silicone oil.

6. An electrostatic charge image developer which is used for an image forming apparatus, comprising:

a carrier and an electrostatic charge image developing toner that includes toner particles that have an average circularity of 0.98 to 1.00 and a number-particle diameter distribution index (lower GSD) on a small diameter side of 1.22 or more, and contain at least vinyl resin, and an external additive that contains silica particles having a compression aggregation degree of 60% to 95% and a particle compression ratio of 0.20 to 0.40.

7. An electrostatic charge image developing toner which is used for an image forming apparatus, comprising:

toner particles that have an average circularity of 0.98 to 1.00 and a number-particle diameter distribution index (lower GSD) on a small diameter side of 1.22 or more and contain at least vinyl resin, and an external additive that contains silica particles having a compression aggregation degree of 60% to 95% and a particle compression ratio of 0.20 to 0.40.

* * * * *